US007603051B2

(12) United States Patent
Kasai

(10) Patent No.: US 7,603,051 B2
(45) Date of Patent: Oct. 13, 2009

(54) IMAGE FORMING APPARATUS INCLUDING A SUCTION/EXHAUST UNIT

(75) Inventor: Kokichi Kasai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 11/582,502

(22) Filed: Oct. 18, 2006

(65) Prior Publication Data

US 2007/0110469 A1 May 17, 2007

(30) Foreign Application Priority Data

Nov. 11, 2005 (JP) ..... P2005-327796
Jul. 31, 2006 (JP) ..... P2006-208414

(51) Int. Cl.
*G03G 21/20* (2006.01)

(52) U.S. Cl. ..... 399/93; 399/92

(58) Field of Classification Search ..... 399/92, 399/93, 98, 405

See application file for complete search history.

(56) References Cited

U.S. PATENT DOCUMENTS

| | | | | |
|---|---|---|---|---|
| 6,094,549 | A * | 7/2000 | Hiraoka et al. | 399/93 |
| 6,327,447 | B1 * | 12/2001 | Nakano et al. | 399/92 |
| 7,003,242 | B2 * | 2/2006 | Kida | 399/92 |
| 7,020,411 | B2 * | 3/2006 | Awaya | 399/92 |
| 7,027,752 | B2 * | 4/2006 | Yon et al. | 399/93 |
| 7,136,613 | B2 * | 11/2006 | Sato et al. | 399/92 X |
| 7,274,892 | B2 | 9/2007 | Awaya | |
| 7,313,342 | B2 * | 12/2007 | Katayama et al. | 399/93 |
| 2005/0135835 | A1 | 6/2005 | Park et al. | |
| 2007/0110469 | A1 | 5/2007 | Kasai | |
| 2007/0121142 | A1 | 5/2007 | Kasai et al. | |
| 2007/0139751 | A1 | 6/2007 | Saito | |

FOREIGN PATENT DOCUMENTS

| | | |
|---|---|---|
| CN | 1630836 | 6/2005 |
| JP | 2002-091270 | 3/2002 |
| JP | 2002-123138 | 4/2002 |
| JP | 2003-295740 | 10/2003 |
| JP | 2004-240270 | 8/2004 |
| JP | 2005-126191 | 5/2005 |
| JP | 2005-338675 | 12/2005 |
| WO | WO 03/069415 | 8/2003 |

OTHER PUBLICATIONS

Yasunori Saito, "Image Forming Apparatus," Unpublished U.S. Appl. No. 11/582,503, filed Oct. 18, 2006.
Kokichi Kasai et al., "Image Forming Apparatus," Unpublished U.S. Appl. No. 11/588,285, Filed Oct. 27, 2006.

* cited by examiner

*Primary Examiner*—Sandra L Brase
(74) *Attorney, Agent, or Firm*—Morgan, Lewis & Bockius LLP

(57) ABSTRACT

An image forming apparatus includes a recoding-medium stacking portion, a recording-medium ejecting portion and a auctioning/exhausting unit. The recording-medium ejecting portion ejects a recording medium on which an image is formed, to the recording-medium stacking portion. The suctioning/exhausting unit suctions air in a vicinity of the recording-medium ejecting portion. The suctioning/exhausting unit exhausts the suctioned air though a filter to an outside of a main body of the image forming apparatus.

12 Claims, 26 Drawing Sheets

IMAGE FORMING APPARATUS INCLUDING A SUCTION/EXHAUST UNIT

BACKGROUND

Technical Field

The invention relates to a copier, a printer or a facsimile adopting the electrophotography system, and further to an image forming apparatus such as a multifunction machine having functions of the above listed devices. Particularly, the invention relates to an image forming apparatus, which can reduce odor or a VOC emitted to the outside of the apparatus from an ejecting section that ejects a recording medium such as a sheet of paper.

SUMMARY

According to an aspect of the invention, an image forming apparatus includes a recoding-medium stacking portion, a recording-medium ejecting portion and a suctioning/exhausting unit. The recording-medium ejecting portion ejects a recording medium on which an image is formed, to the recording-medium stacking portion. The suctioning/exhausting unit suctions air in a vicinity of the recording-medium ejecting portion. The suctioning/exhausting unit exhausts the suctioned air though a filter to an outside of a main body of the image forming apparatus.

BRIEF DESCRIPTION OF THE DRAWINGS

Exemplary embodiments will be described in detail with reference to accompanying drawings wherein.

DETAILED DESCRIPTION

Exemplary embodiments of the invention will be described hereinbelow with reference to the drawings.

FIRST EXEMPLARY EMBODIMENT

Figure 2:
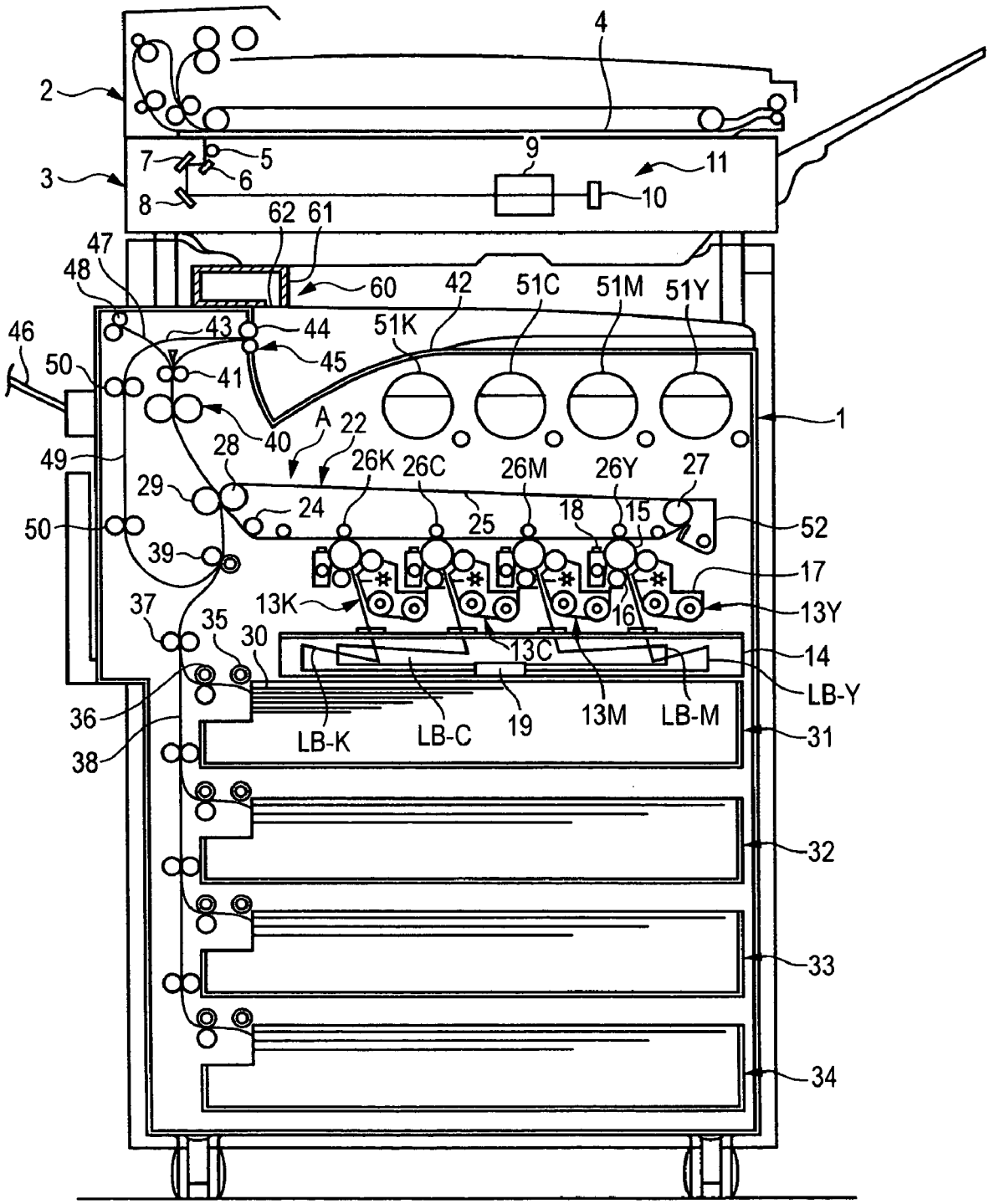
FIG. 2 is an overall configuration diagram of the multifunctional color machine, which serves as the image forming apparatus according to the first exemplary embodiment of the invention.

FIG. 2 is a configuration diagram showing a multifunctional color machine serving as an image forming apparatus according to a first exemplary embodiment of the invention. This multifunctional color machine has functions of a copier, a printer and a facsimile.

As shown in FIG. 2, the multifunctional color machine 1 includes a scanner unit 3, which serves as an image reading device, on an upper portion of the multifunctional color machine 1. The multifunctional color machine 1 is connected to an personal computer (not shown) via a network (not shown).

The multifunctional color machine 1 serves as a facsimile, which copies a document read by the scanner unit 3; which produces a print on the basis of image data transmitted from the personal computer; and which transmits and receives image data via a phone line.

In FIG. 2, reference numeral 1 designates a main body of the multifunctional color machine. An automatic document feeder (ADF) 2 and the scanner unit 3 are disposed on the upper portion of the main body 1 of the multifunctional color machine. The ADF 2 automatically feeds original documents (not shown) one by one in a separated manner. The scanner unit 3 reads the original document transported from the automatic document feeder 2. The scanner unit 3 illuminates the original document on a platen glass 4 by means of a light source 5; and exposes an image reading element 10, which includes a CCD, to an image of light reflected from the original document via a scaling-down optical system 11, which includes a full-rate mirror 6, half-rate mirrors 7, 8 and an imaging lens 9, in a scanning manner. The image reading device 10 reads the image of light reflected from coloring materials on the original document at a predetermined density (e.g., 16 dots/mm).

An image of light reflected from the original document read by the scanner unit 3 is sent, as reflectivity data of three colors red (R), green (G), and blue (B) (each set of data consisting of eight bits), to an image processor (IPS; not shown) If necessary, the image processor performs predetermined image processing on the image data of the original document as will be described later. The predetermined image processing may include shading correction, positional displacement correction, brightness/color space conversion, gamma correction, frame erasing and color/scroll edition. The image processor may perform the predetermined image processing on image data sent from the personal computer (not shown).

The image data that have undergone the predetermined image processing in the image processor are converted into halftone data of four colors; namely, yellow (Y), magenta (M), cyan (C), and black (K) (each set of data consisting of eight bits), by the image processor 12 (not shown). As will be described later, the thus-converted image data are sent to an ROS (Raster Output Scanner) 14 common among image-forming units 13Y, 13M, 13C, and 13K of respective colors yellow (Y), magenta (M), cyan (C), and black (K). The ROS 14 serving as an image exposing device effects image exposure by use of a laser beam LB in accordance with halftone data pertaining to a predetermined color. Images are not limited to color images. As a matter of course, the image forming apparatus may only form black-and-white images.

As shown in FIG. 2, image-forming means A is provided in the main body 1 of the multifunctional color machine. The four image-forming units 13Y, 13M, 13C, and 13K of four colors yellow (Y), magenta (M), cyan (C), and black (K) are arranged in parallel in this image-forming means A while being horizontally spaced at a given interval.

All four of these image-forming units 13Y, 13M, 13C, and 13K are configured similarly. Each of the image-forming units essentially comprises a photosensitive drum 15 which serves as an image carrier to be rotationally driven at a predetermined speed; a primary electrification roll 16 for uniformly electrifying the surface of the photosensitive drum 15; an ROS 14 acting as an image exposing device which exposes the surface of the photosensitive drum 15 to an image responsive to a predetermined color, to thus form an electrostatic latent image; a development device 17 for developing the electrostatic latent image formed on the photosensitive drum 15 with toner of predetermined color; and a cleaner 18 for cleaning the surface of the photosensitive drum 15. The image-forming member disposed around the photosensitive drum 15 is formed into an integrated unit. The unit can be individually removed for replacement from the main body 1 of the multifunctional color machine.

As shown in FIG. 2, the ROS 14 is configured so as to be common among the four image-forming units 13Y, 13M, 13C, and 13K. The ROS 14 modulates four unillustrated semiconductor laser units in accordance with halftone data pertaining to respective colors, to thus cause the semiconductor laser units to emit laser beams LB-Y, LB-M, LB-C, and LB-K according to the halftone data. As a matter of course, the ROS 14 may be separately configured for each of the plurality of image-forming units. The laser beams LB-Y, LB-M, LB-C, and LB-K emitted from the semiconductor laser units are radiated onto a polygon mirror 19 by way of an unillustrated f-θ lens and are deflected by the polygon mirror 19 to thus effect scanning. The laser beams LB-Y, LB-M, LB-C, and LB-K, which have been deflected by the polygon mirror 19 to thus effect scanning, are caused to scan and radiate an exposure point on the photosensitive drum 15 from an obliquely lower direction by way of an unillustrated imaging lens and a plurality of mirrors.

As shown in FIG. 2, the ROS 14 is for effecting scan and radiation of the photosensitive drum 15 from a lower direction in accordance with the image. The ROS 14 has a potential risk of being stained with toner as a result of toner falling from the development units 17 of the respective four image-forming units 13Y, 13M, 13C, and 13K, which are located above the ROS 14. For this reason, the environs of the ROS 14 are sealed with a rectangular-parallelepiped frame 20. Clear glass windows 21Y and 21M shown in FIG. 3, which act as shielding members, are provided in the top of the frame 20 in order to expose the photosensitive drums 15 of the respective image-forming units 13Y, 13M, 13C, and 13K to the four laser beams LB-Y, LB-M, LB-C, and LB-K (clear glass windows corresponding to the image-forming units 13C and 13K not shown).

The image processor sequentially outputs image data pertaining to the respective colors to the ROS 14 provided commonly among the image-forming units 13Y, 13M, 13C, and 13K of respective colors yellow (Y), magenta (M), cyan (C), and black (K). The laser beams LB-Y, LB-M, LB-C, and LB-K emitted from the ROS 14 in accordance with the image data are used for scanning and exposing the surfaces of the corresponding photosensitive drums 15, to thus form electrostatic latent images. The electrostatic latent images formed on the photosensitive drums 15 are developed as toner images of respective colors yellow (Y), magenta (M), cyan (C) and black (K) by the development units 17Y and 17M shown in FIG. 3 (development units corresponding to the image forming units 13C and 13K not shown).

The toner images of yellow (Y), magenta (M), cyan (C), and black (K) colors, which are sequentially formed on the photosensitive drums 15 of the respective image-forming units 13Y, 13M, 13C, and 13K, are transferred, in an overlapping manner, onto an intermediate transfer belt 25—being provided at a position above the respective image-forming units 13Y, 13M, 13C, and 13K and serving as an endless belt member of a transfer unit 22—by means of four primary transfer rolls 26Y, 26M, 26C, and 26K. These primary transfer rolls 26Y, 26M, 26C, and 26K are provided on the back of the intermediate transfer belt 25 and at positions corresponding to the photosensitive drums 15 of the respective image-forming units 13Y, 13M, 13C, and 13K. Volume resistivity of the primary transfer rolls 26Y, 26M, 26C, and 26K of the present embodiment is adjusted to a resistance value of $10^5$ to $10^8$ Ωcm. A transfer bias power source (not shown) is connected to the primary transfer rolls 26Y, 26M, 26C, and 26K. A transfer bias of polarity (positive polarity) opposite predetermined toner polarity is applied to the primary transfer rolls 26Y, 26M, 26C, and 26K at a predetermined timing.

As shown in FIG. 2, the intermediate transfer belt 25 is looped over a drive roll 27, a tension roll 24, and a backup roll 28 at given tension. The intermediate transfer belt 25 is driven in a circulating manner at a predetermined speed in the direction of the arrow by the drive roll 27, which is rotationally driven by an unillustrated custom-designed drive motor having a superior constant velocity characteristic. The intermediate transfer belt 25 is formed from, e.g., a belt raw material (rubber or resin) which does not cause any charge-up.

As shown in FIG. 2, the toner images of respective yellow (Y), magenta (M), cyan (C), and black (K) colors, which have been transferred in an overlapping manner on the intermediate transfer belt 25, are transferred to a sheet 30, which serves as a recording medium, through secondary transfer by means of a secondary transfer roll 29 remaining in compressed contact with the backup roll 28. The sheet 30 having the toner images of respective colors transferred thereon is transported to a fixing unit 40 located in an elevated position. The secondary transfer roll 29 remains in compressed contact with the side of the backup roll 28, and is arranged to transfer the toner images of the respective colors to the sheet 30, which is transported upward from below, through secondary transfer.

In relation to the sheet 30, a sheet of predetermined size is fed from any one of a plurality of sheet-feeding trays 31, 32, 33, and 34, which are provided in the lower portion of the main body of the multifunctional color machine 1, while being separated one at a time by a feed roll 35 and a retard roll 36, by way of a sheet transport path 38 having a transport roll 37. The sheet 30 fed from any one of the sheet-feeding trays 31, 32, 33, and 34 is temporarily stopped by a registration roll 39 and again fed to the secondary transfer position on the intermediate transfer belt 25 by the registration roll 39 in synchronism with the image on the intermediate transfer belt 25.

As shown in FIG. 2, the fixing unit 40 applies fixing treatment to the sheet 30 on which the toner images of respective colors are transferred with heat and pressure. Subsequently, a transport roll 41 transports the sheet 30 to a first sheet transport path 43. The first sheet transport path 43 is provided to eject the sheet 30 to a face-down tray 42, which serves as a recording-medium stacking portion, with an image formation surface of the sheet 30 facing downward. A ejection roll 44, which is disposed at the exit of the first sheet transport path 43, ejects the sheet 30 through the first sheet transport path 43 to the face-down tray 42 disposed at the upper portion of the main body 1 of the multifunctional color machine. An area of the main body 1 of the multifunctional color machine, where the ejection roll 44 is provided, constitutes a sheet ejecting portion 45, which serves as a recording-medium ejecting portion for ejecting the sheet 30 to the face-down tray 42.

The scanner unit 3 is disposed at the upper portion of the main body 1 of the image forming apparatus. Therefore, the face-down tray 42, which serves as a recording-medium stacking portion, is provided in a body formed of the main body 1 of the image forming apparatus and the scanner unit 3.

There may also be a case where the image forming apparatus is not equipped with the scanner unit 3. In this case, the recording-medium stacking portion is provided in the upper portion of the main body 1 of the image forming apparatus.

In the case where the sheet 30 on which the images are formed as mentioned above is ejected with the image formation surface facing upward, a ejection roll 48 ejects the sheet 30 through a second sheet transport path 47 to a face-up tray 46. The second sheet transport path 47 is used to eject a sheet of paper to the face-up tray, which serves as a second ejection tray, with the image formation surface facing upward. The ejection roll 48 is disposed at the exit of the second sheet transport path 47. The face-up tray 46 is disposed on a side portion (left side surface in FIG. 2) of the main body 1.

As shown in FIG. 2, when the multifunctional color machine produces a full-color two-sided copy, a switching gate (not shown) switches the transport direction of the sheet 30 having an image fixed on one side thereof without the sheet 30 directly ejected to the face-down tray 42 by the ejection roll 44. After the ejection roll 44 has been temporarily stopped, the ejection roll 44 is reversely rotated. Then, the ejection roll 44 transports the sheet 30 to a double-sided sheet transport path 49. A transport roll 50, which is disposed along the transport path 49, transports the sheet 30 through the double-sided sheet transport path 49 to the registration roll 39 with both surfaces of the sheet 30 inverted. After an image has been transferred and fixed onto the back of the sheet 30, the sheet 30 is ejected to either the face-down tray 42 or the face-up tray 46 through the first sheet transport path 43 or the second sheet transport path 47.

In FIG. 2, reference numerals 51Y, 51M, 51C, and 51K designate toner cartridges for supplying toner of predetermined colors to the development units 17 of respective yellow (Y), magenta (M), cyan (C), and black (K) colors. Reference numeral 52 designates a cleaner for removing the toner, or the like, still remaining on the intermediate transfer belt 25.

Figure 3:
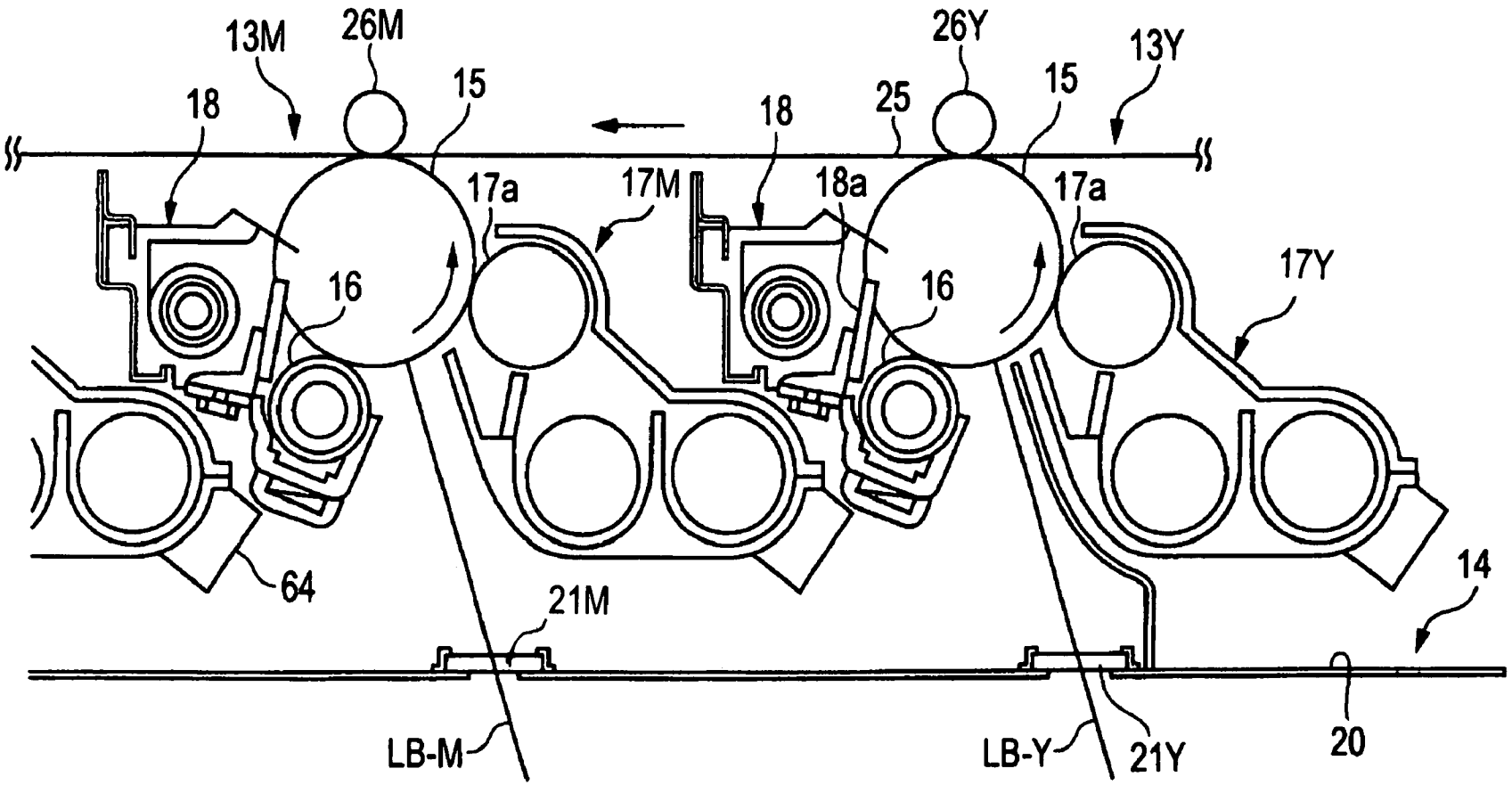
FIG. 3 is a configuration diagram showing an image forming section of the multifunctional color machine, which serves as the image forming apparatus according to the first exemplary embodiment of the invention.

FIG. 3 shows the respective image forming units of the multifunctional color machine.

As shown in FIG. 3, all the four image-forming units 13Y, 13M, 13C, and 13K of respective yellow (Y), magenta (M), cyan (C), and black (K) colors are configured similarly. As mentioned above, the four image-forming units 13Y, 13M, 13C, and 13K are configured so as to sequentially form toner images of respective yellow, magenta, cyan, and black colors at predetermined timing. As mentioned previously, each of the image-forming units 13Y, 13M, 13C, and 13K of respective colors has the photosensitive drum 15, and the surface of the photosensitive drum 15 is uniformly electrified by the primary electrification roll 16. Subsequently, the surface of the photosensitive drum 15 is exposed to a scanning of the laser beam LB for image formation purpose, which is emitted from the ROS 14 in accordance with image data, whereupon electrostatic latent images responsive to the respective colors are formed. The laser beam LB used for exposing the photosensitive drum 15 in a scanning manner is set so as to be emitted from a position which is oblique; specifically, slightly right and below, with reference to the position immediately below the photosensitive drum 15. The electrostatic latent images formed on the photosensitive drum 15 are developed with toner of respective yellow, magenta, cyan, and black colors by means of development rolls 17*a* of the development devices 17 of the respective image-forming units 13Y, 13M, 13C, and 13K, to thus form visible toner images. These visible toner images are sequentially transferred onto the intermediate transfer belt 25 by means of electrification developing at the primary transfer roll 26.

Residual toner, paper dust, and the like, have been removed from the surface of the photosensitive drum 15, which has undergone processing pertaining to a toner transfer process, by means of the cleaner 18, and the surface prepares for the next image-forming process. The cleaner 18 has a cleaning blade 18*a*, and the toner, paper dust, and the like, still remaining on the photosensitive drum 15 are eliminated by the cleaning blade 18*a*.

Incidentally, according to the first exemplary embodiment, an image forming apparatus includes a recoding-medium stacking portion, a recording-medium ejecting portion and a suctioning/exhausting unit. The recording-medium ejecting portion ejects a recording medium on which an image is formed, to the recording-medium stacking portion. The suctioning/exhausting unit suctions air in a vicinity of the recording-medium ejecting portion. The suctioning/exhausting unit exhausts the suctioned air though a filter to an outside of a main body of the image forming apparatus.

Also, the suctioning/exhausting unit includes a suction duct disposed above the recording-medium ejecting portion. The suctioning/exhausting unit suctions through the suction duct the air in the vicinity of the recording-medium ejecting portion.

Figure 4:
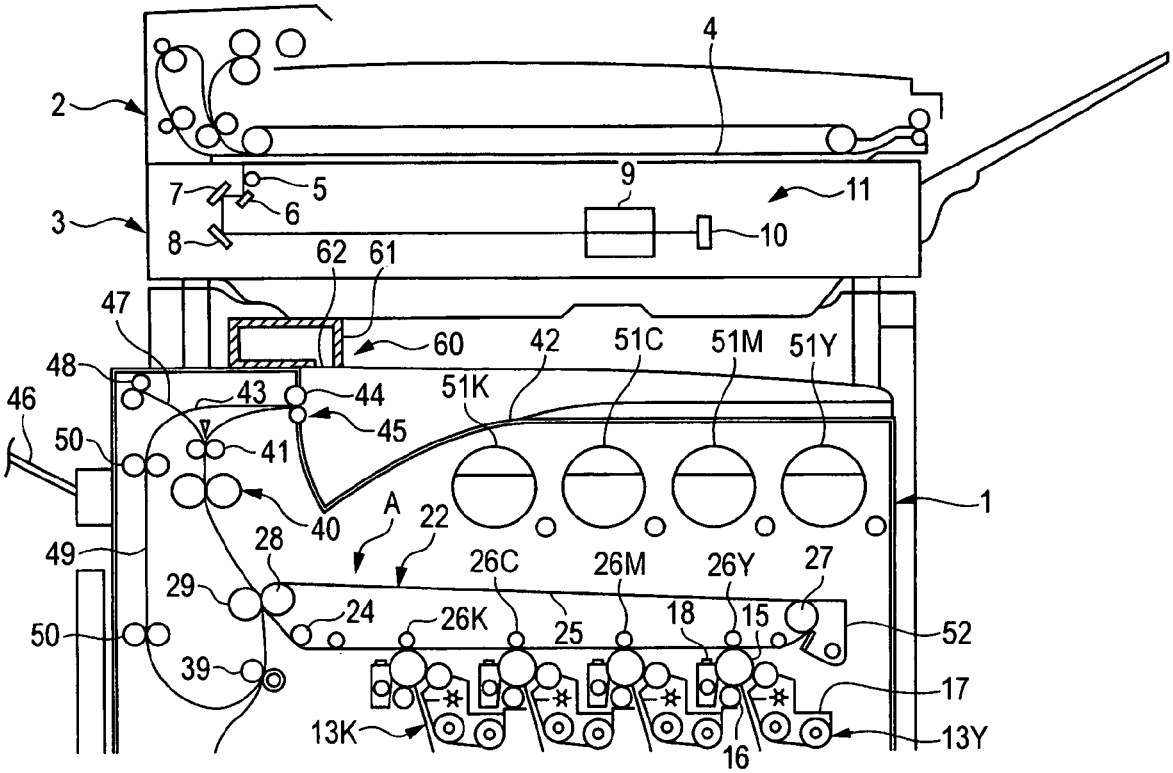
FIG. 4 is an overall configuration diagram showing the main portion of the multifunctional color machine, which serves as the image forming apparatus according to the first exemplary embodiment of the invention.
Figure 5:
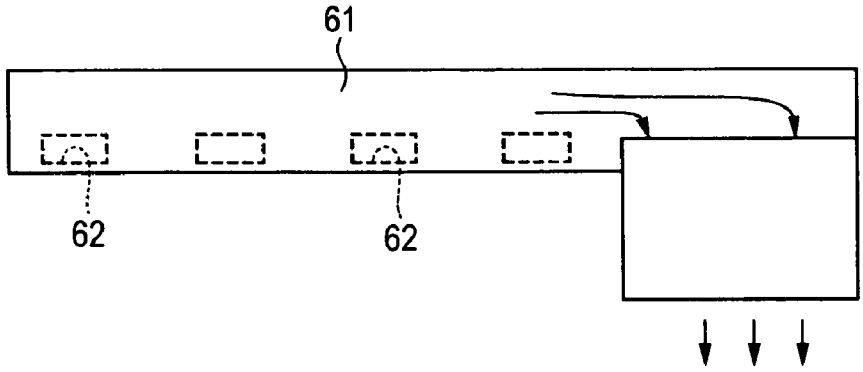
FIG. 5 is a configuration diagram showing layout of air inlet ports of a suctioning/exhausting unit of the multifunctional color machine, which serves as the image forming apparatus according to the first exemplary embodiment of the invention.

As shown in FIG. 4, the multifunctional color machine has a suctioning/exhausting unit 60, which suctions air from the vicinity of the sheet ejecting portion 45 of the main body 1 and exhausts the thus-suctioned air to the outside of the main body 1 of the multifunctional machine through a filter. The suctioning/exhausting unit 60 has a suction duct 61 disposed above the sheet ejecting portion 45. The suctioning/exhausting unit 60 is configured to suction air, which is in the vicinity of the sheet ejecting portion 45 by the suction duct 61. The suction duct 61 is made of synthetic resin or metal so as to have a rectangular section shape. As shown in FIG. 5, plural suction ports 62 are formed, while being spaced at substantially constant intervals, in a longitudinal direction at positions corresponding to the upper portion of the sheet ejecting portion 45.

Figure 6A:
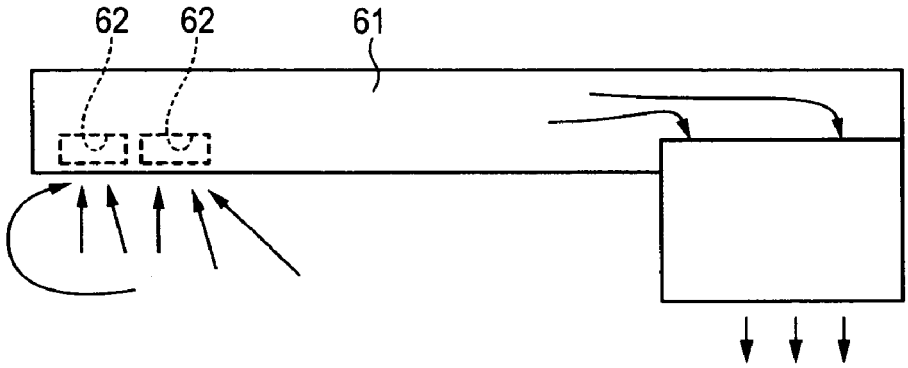
FIGS. 6A and 6B are a configuration diagram and a perspective view, showing another layout of the air inlet ports of the suctioning/exhausting unit of the multifunctional color machine, which serves as the image forming apparatus according to the first exemplary embodiment of the invention.
Figure 6B:
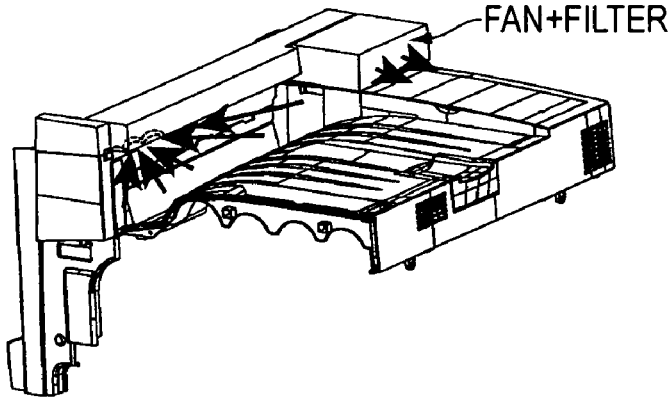

As shown in FIG. 6, the suction ports 62 of the suction duct 61 may be concentrated on the front side (the proximal side) of the sheet ejecting portion 45. In other words, the suction ports 62 may be concentrated on one side of the sheet ejecting portion 45 in a front and back direction, which is perpendicular to an ejection direction in which the sheet ejecting portion 45 ejects the sheet 30 and which is parallel to a surface of the sheets 30 stacked on the face-down tray 42.

In this case, air can be suctioned in a concentrated manner through the suction ports 62 concentrated on the front side (proximal side) of the sheet ejecting portion 45. Therefore, even if air, which is trapped between the sheet 30 and the face-down tray 42 when the sheet 30 being ejected onto the face-down tray 42 falls on the face-down tray 42 due to its own weight, is discharged to the front side (proximal side) of the face-down tray 42 because an escape route for such air cut off, the suctioning/exhausting unit 60 can effectively suction the air discharged to the front side (proximal side) of the face-down tray 42 through the suction ports 62 concentrated on the front side (proximal side) of the sheet ejecting portion 45.

The suction duct 61 is provided between the upper end face of the sheet ejecting portion 45 of the main body 1 of the multifunctional machine and the lower end face of the scanner unit 3, so as to close a space defined between the upper end face of the main body 1 of the multifunctional machine and the lower end face of the scanner unit 3.

Figure 1:
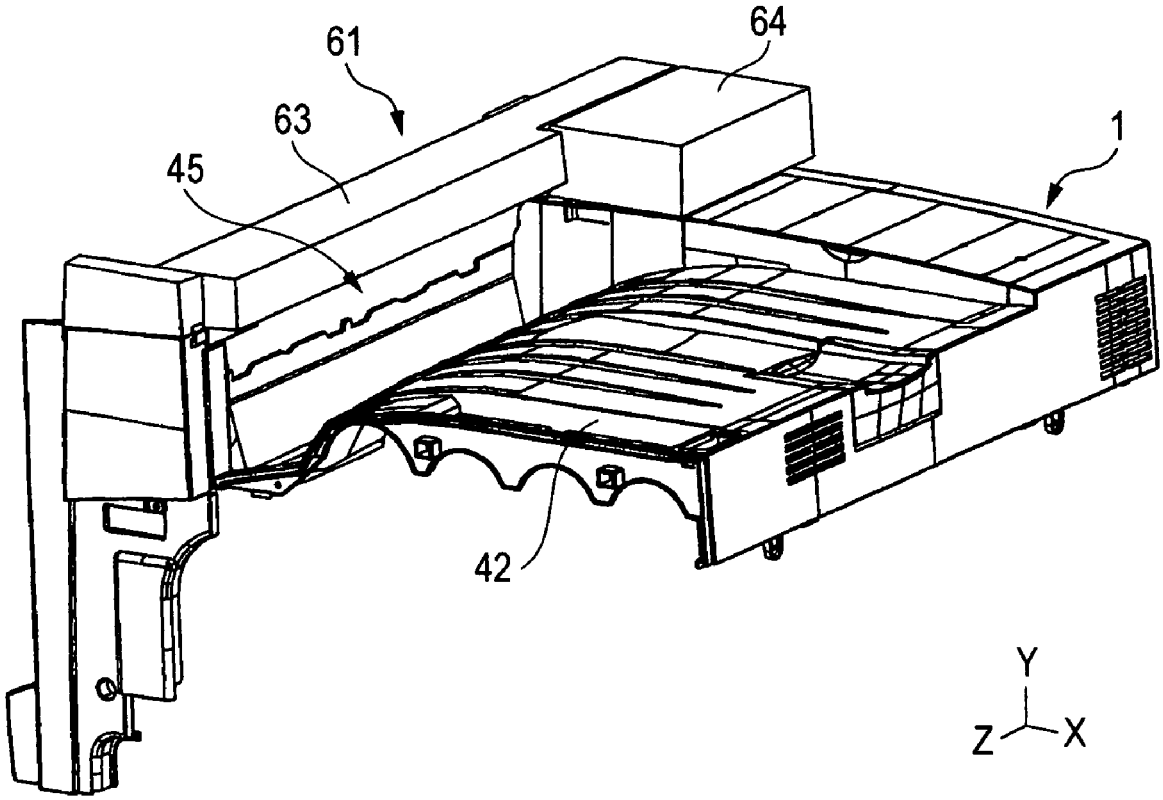
FIG. 1 is a perspective configuration diagram showing the main portion of a multifunctional color machine, which serves as an image forming apparatus according to a first exemplary embodiment of the invention.
Figure 7:
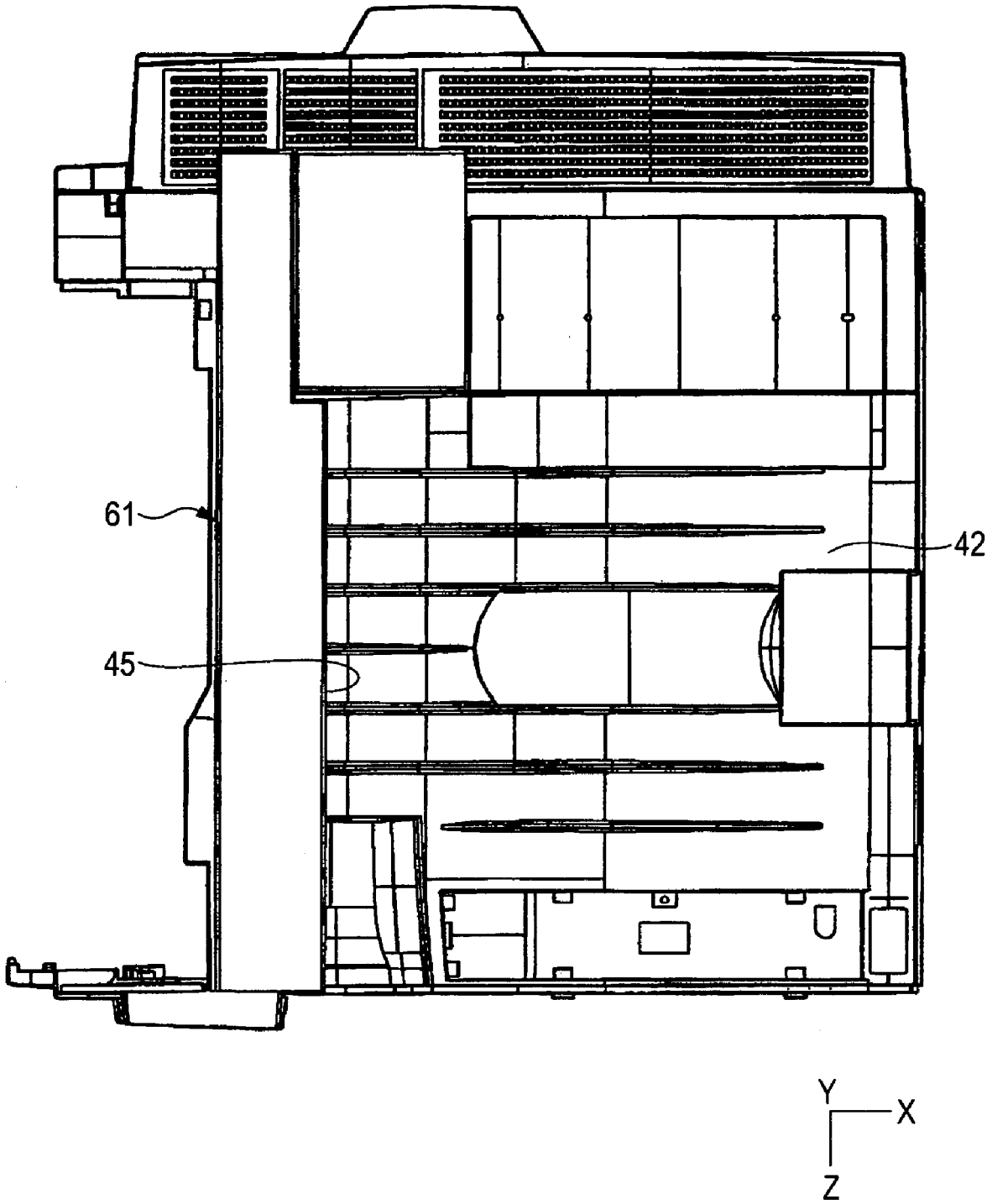
FIG. 7 is a plane configuration diagram showing the main portion of the multifunctional color machine, which serves as the image forming apparatus according to the first exemplary embodiment of the invention.

As shown in FIGS. 1 and 7, the suction duct 61 is formed into an essentially L shape. The suction duct 61 includes a linear portion 63 provided linearly from the proximal side of the main body 1 of the multifunctional machine toward the distal side of the same; and an exhaust portion 64, which has a short length and is disposed at a distal end of the linear portion 63 so as to cross the linear portion 63 at right angles. The exhaust portion 64 is provided so as to face the sheet ejection direction (the rightward direction in FIG. 1) of the main body 1 of the multifunctional machine.

Figure 8:
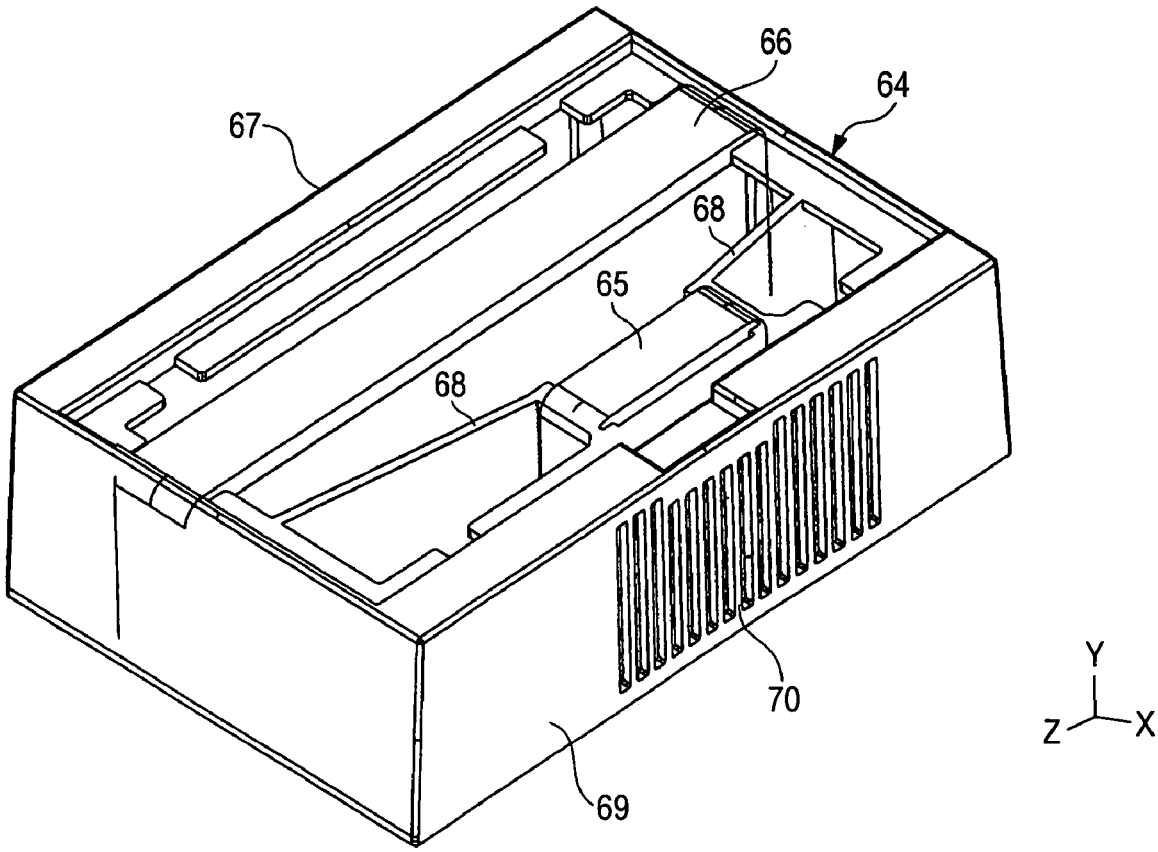
FIG. 8 is a perspective configuration diagram showing an air outlet portion of the suctioning/exhausting unit of the multifunctional color machine, which serves as the image forming apparatus according to the first exemplary embodiment of the invention.
Figure 9:
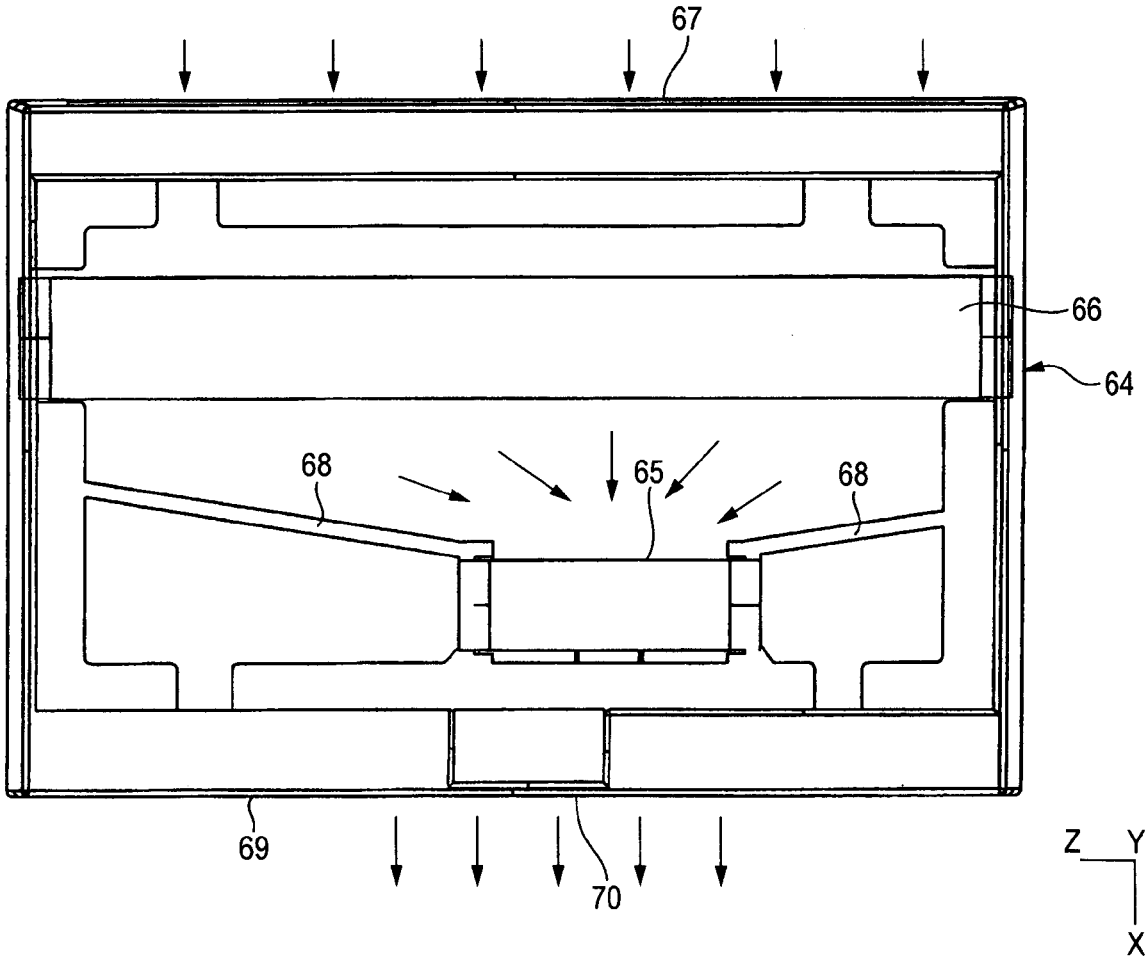
FIG. 9 is a plane configuration diagram showing the air outlet portion of the suctioning/exhausting unit of the multifunctional color machine, which serves as the image forming apparatus according to the first exemplary embodiment of the invention.

As shown in FIGS. 8 and 9, an exhaust fan 65 and a filter 66 are accommodated in the exhaust portion 64. The whole surface of an end face 67, which is provided at a deeper position of the exhaust portion 64, is opened. A portion of the inside of the exhaust portion 64, which is close to an upstream side of the exhaust fan 65, is formed narrowly by a partition wall 68 so as to gather air, which has passed through the filter 66, into the exhaust fan 65. The air exhausted by the exhaust fan 65 has slightly spread and then exhausted to the outside through a louver section 70 formed in an end face 69 on the proximal side of the exhaust portion 64.

The filter 66 includes at least two selected from the group consisting of (i) a deodorization filter, (ii) a filter for absorbing or decomposing a volatile organic compound and (iii) a filter for absorbing or decomposing ozone. In this exemplary embodiment, the filter 66 is formed of a filter for deodorization and another filter for adsorbing or dissolving a VOC.

As shown in FIG. 2, in the multifunctional color machine of the present embodiment, toner images of respective yellow (Y), magenta (M), cyan (C), and black (K) colors are formed by the image-forming units 13Y, 13M, 13C, and 13K of respective yellow (Y), magenta (M), cyan (C), and black (K) colors. After having been transferred in an overlapping manner onto the intermediate transfer belt 25 through primary transfer operation, the toner images of respective yellow (Y), magenta (M), cyan (C), and black (K) colors are collectively transferred to the sheet 30 from the intermediate sheet 25 through secondary transfer.

The toner images of respective yellow (Y), magenta (M), cyan (C), and black (K) colors, which have been collectively transferred to the sheet 30, are fixed by heat and pressure by means of the fixing unit 40. Subsequently, the sheet 30 is output from the sheet ejecting portion 45 to the face-down tray 42 that is provided in the upper portion of the main body 1 of the multifunctional machine, whereby the image-forming process is completed.

At that time, when the toner images of respective yellow (Y), magenta (M), cyan (C), and black (K) colors are fixed onto the sheet 30 by heat and pressure by means of the fixing unit 40, an odor originates from toner or a volatile organic compound (VOC) may be produced. The odor having originated from the toner or the volatile organic compound (VOC) is exhausted to the outside of the main body 1 of the multifunctional color machine along with the sheet 30 when the sheet 30 is ejected from the sheet ejecting portion 45 to the face-down tray 42, which is disposed in the upper portion of the main body 1 of the multifunctional color machine.

As shown in FIGS. 1 and 4, in the first exemplary embodiment, the suction duct 61 is provided at a position above the sheet ejecting portion 45. The exhaust fan 65 of the suction duct 61 is driven in synchronism with image formation operation.

In the first exemplary embodiment, the exhaust fan 65 is driven in synchronism with initiation of image formation operation. Even after the image formation operation has been completed, the exhaust fan 65 is configured to operate for a predetermined period.

The odor, which is produced when an unfixed toner image is fixed to the sheet 30 by means of the fixing unit 40, or a VOC are exhausted to the outside of the main body 1 of the multifunctional color machine through the sheet ejecting portion 45 along with movement of the sheet 30. The odor or VOC, which has been exhausted to the outside of the main body 1 of the multifunctional color machine from the sheet ejecting portion 45 is suctioned through the suction ports 62 of the suction duct 61. As shown in FIGS. 8 and 9, after the filter 66 provided in the discharge portion of the suction duct 61 absorbs or eliminates the odor or VOC, the exhaust fan 65 exhausts air to the outside of the main body 1 of the multifunctional color machine.

As mentioned above, in the color multifunctional machine of the first exemplary embodiment, the suction duct 61 is provided in the upper portion of the sheet ejecting portion 45 of the main body 1 of the multifunctional color machine.

Further, the suction duct 61 and the exhaust fan 65 are provided outside of the main body 1 of the multifunctional color machine independently from the main body 1.

Figure 10:
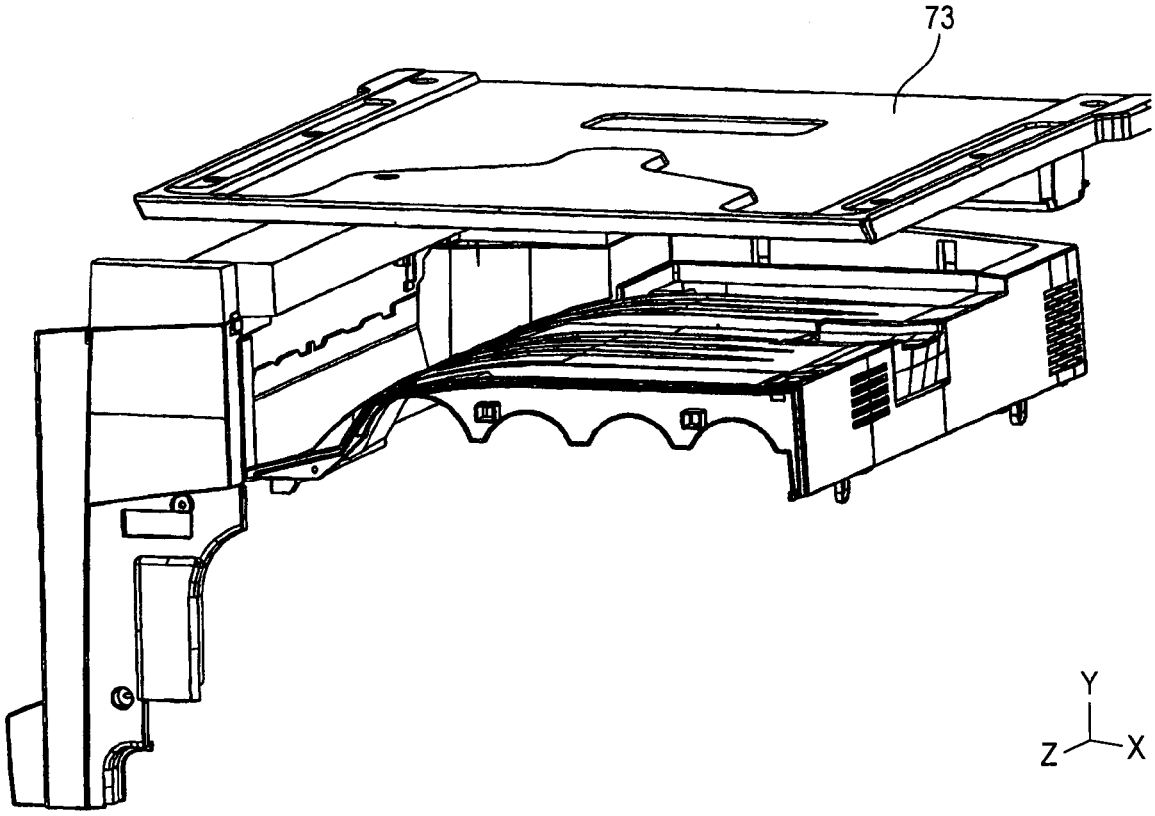
FIG. 10 is a perspective configuration diagram showing a mount member on which mounted is a scanner unit of the multifunctional color machine, which serves as the image forming apparatus according to the first exemplary embodiment of the invention.

As shown in FIG. 10, the rear end of the face-down tray 42 in –Z direction in FIG. 10 and an end of the face-down tray 42 in the sheet ejection direction (+X direction in FIG. 10) are opened between the main body 1 of the multifunctional color machine and the scanner unit 3. Therefore, an odor or a VOC may escape through the opening at the rear end of the face-down tray 42 or the opening at the end of the face-down tray 42 in the sheet ejection direction. In FIG. 10, reference numeral 73 designates a mount table where the scanner unit 3 is to be mounted.

Figure 11:
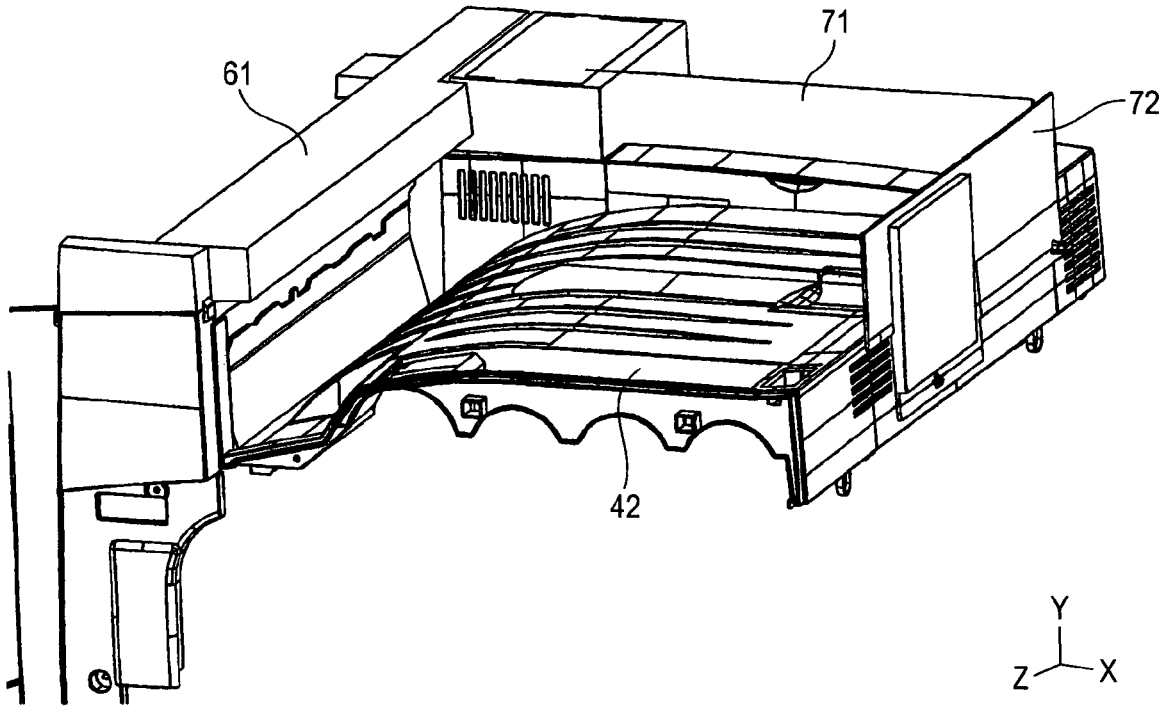
FIG. 11 is a perspective configuration diagram showing a modification of the multifunctional color machine, which serves as the image forming apparatus according to the first exemplary embodiment of the invention.

As shown in FIG. 11, in this case, the opening at the rear end of the face-down tray 42 and the opening at the end of the face-down tray 42 in the sheet ejection direction may be closed by shielding plates 71, 72.

SECOND EXEMPLARY EMBODIMENT

Figure 12:
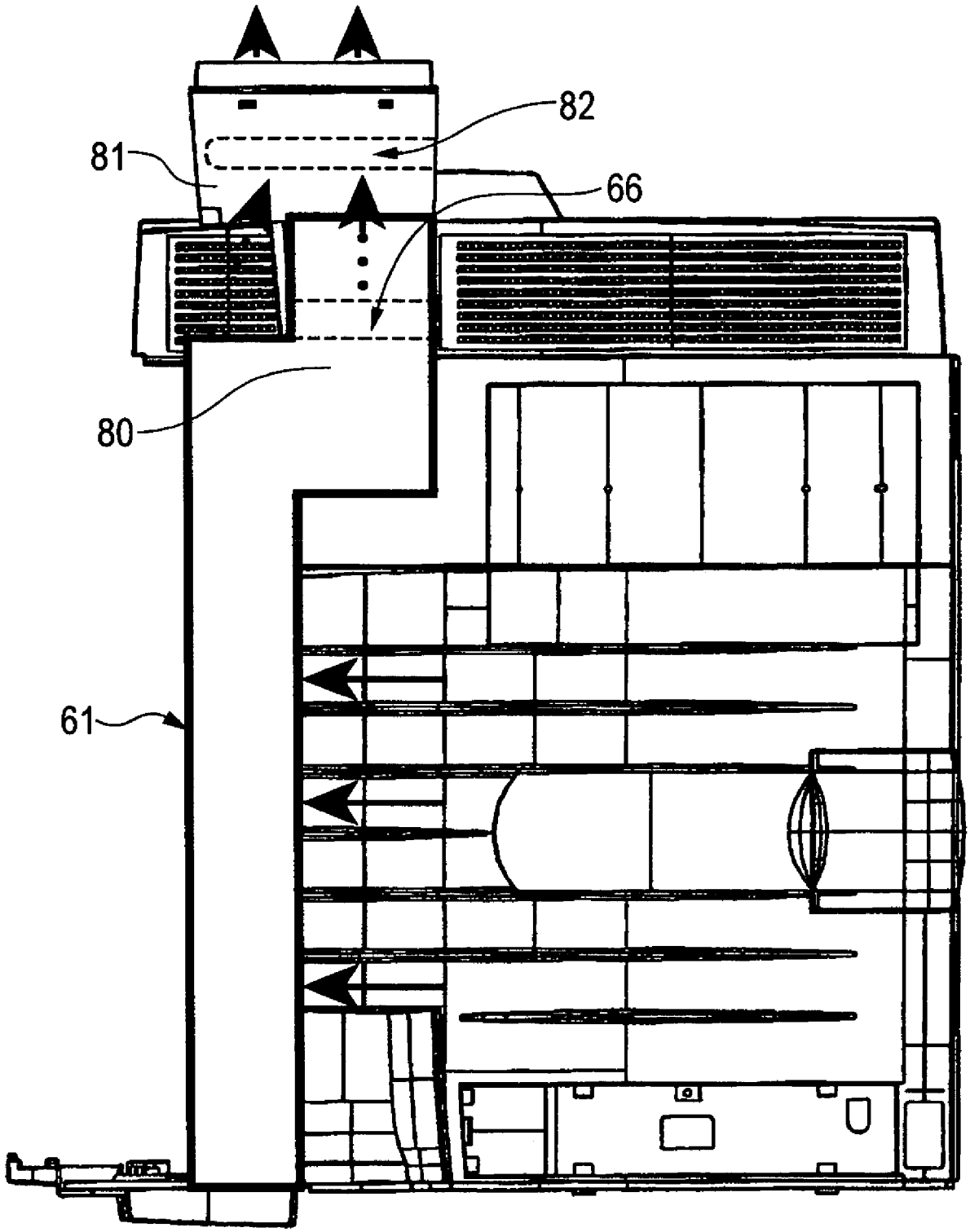
FIG. 12 is a plane configuration diagram showing the main portion of a multifunctional color machine, which serves as an image forming apparatus according to a second exemplary embodiment of the invention.

FIG. 12 shows a second exemplary embodiment of the invention. Those elements, which are the same as those of the first exemplary embodiment, are assigned the same reference numerals. The second exemplary embodiment further includes an exhaust fan disposed inside of the main body of the image forming apparatus. The suction duct is merged with an exhaust path disposed inside the main body of the image forming apparatus. The exhaust fan exhausts the air in the vicinity of the recording-medium ejecting portion through the suction duct and air in the main body of the image forming apparatus through the exhaust duct. The filter is disposed on an upstream side of a merging position where the suction duct and the exhaust path are merged with each other, in an air exhaust direction.

As shown in FIG. 12, in the multifunctional color machine of the second exemplary embodiment, the exhaust portion 64 having a built-in exhaust fan is not provided in the downstream path of the suction duct 61, but a downstream path 80 of the suction duct 61 is merged with an exhaust path 81 provided in the main body 1 of the multifunctional color machine. Air is exhausted by means of an exhaust fan 82, which is provided on a back-side position of the main body 1 and inside the main body 1 of the multifunctional color machine.

The filter 66 is provided on an upstream side of the merged portion where the suction duct 61 and the exhaust path 81 are merged and in the downstream path 80 of the suction duct 61. The filter 66 has at least two selected from the group consisting of (i) a deodorization capability, (ii) a capability of absorbing or decomposing a volatile organic compound and (iii) a capability of absorbing or decomposing ozone.

Since the other configurations and operation of the Second exemplary embodiment are identical with those of the first exemplary embodiment, their explanations are omitted.

THIRD EXEMPLARY EMBODIMENT

Figure 13:
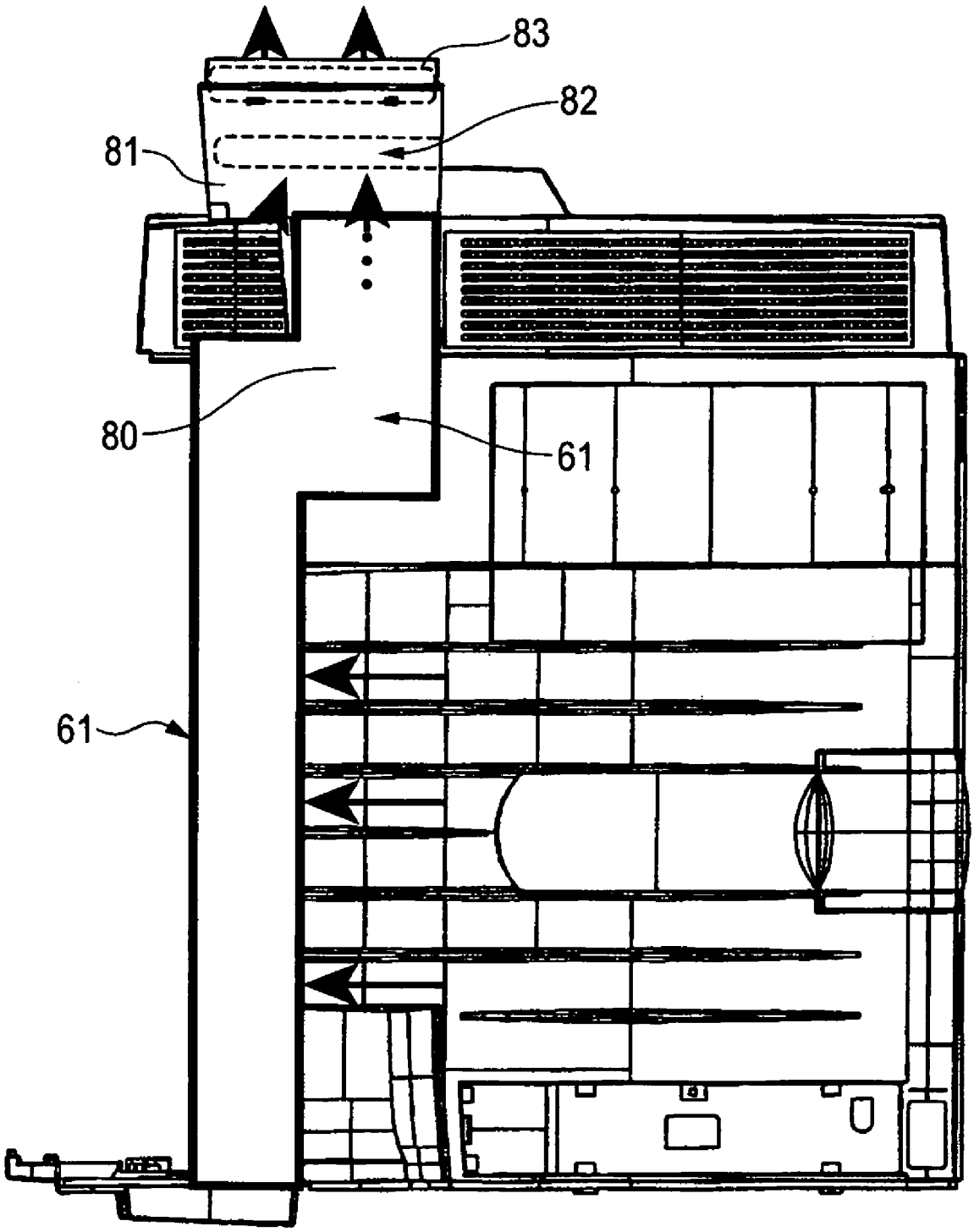
FIG. 13 is a perspective configuration diagram showing the main portion of a multifunctional color machine, which serves as an image forming apparatus according to a third exemplary embodiment of the invention.

FIG. 13 shows a third exemplary embodiment of the invention. Those elements, which are the same as those of the first exemplary embodiment, are assigned the same reference numerals. The third exemplary embodiment further includes an exhaust fan disposed inside of the main body of the image forming apparatus. The suction duct is merged with an exhaust path disposed inside the main body of the image forming apparatus. The exhaust fan exhausts the air in the vicinity of the recording-medium ejecting portion through the suction duct and air in the main body of the image forming apparatus through the exhaust duct. The air auctioned through the suction dust is exhausted through the filter to the outside of the image forming apparatus. The air auctioned through the exhaust path is exhausted through the filter to the outside of the image forming apparatus.

In the third exemplary embodiment, the filter may have at least two selected from the group consisting of (i) a deodorization capability, (ii) a capability of absorbing or decomposing a volatile organic compound and (iii) a capability of absorbing or decomposing ozone.

Further, in the third exemplary embodiment, the filter may have at least two selected from the group consisting of (i) a deodorization filter, (ii) a filter for absorbing or decomposing a volatile organic compound and (iii) a filter for absorbing or decomposing ozone.

As shown in FIG. 13, in the multifunctional color machine of the third exemplary embodiment, the exhaust portion 64 having a built-in exhaust fan is not provided in the downstream path 80 of the suction duct 61, but the downstream path 80 of the suction duct 61 is merged with an exhaust path 81 provided in the main body 1 of the multifunctional color machine. The exhaust fan 82, which is provided on a back-side position of the main body 1 and inside the main body 1 of the multifunctional color machine, exhausts air.

As shown in FIG. 13, the exhaust fan 82 for exhausting air from the inside of the main body land a filter 83 are provided at the exit section of the exhaust path 81 provided in the main body 1 of the multifunctional color machine. The filter 83 may be configured to have at least two selected from the group consisting of (i) a deodorization capability, (ii) a capability of absorbing or decomposing a volatile organic compound and (iii) a capability of absorbing or decomposing ozone. In the third exemplary embodiment, the filter 83 has all the three capabilities, that , (i) a deodorization capability, (ii) a capability of absorbing or decomposing a volatile organic compound and (iii) a capability of absorbing or decomposing ozone.

In place of using the filter having at least two selected from the group consisting of (i) a deodorization capability, (ii) a capability of absorbing or decomposing a volatile organic compound and (iii) a capability of absorbing or decomposing ozone, the filter 83 may be configured to have at least two selected from the group consisting of (i) a deodorization filter, (ii) a filter for absorbing or decomposing a volatile organic compound and (iii) a filter for absorbing or decomposing ozone. In this case, the filter 83 may be formed of the three filters, that is, (i) a deodorization filter, (ii) a filter for absorbing or decomposing a volatile organic compound and (iii) a filter for absorbing or decomposing ozone.

Since the other configurations and operations of the third exemplary embodiment are identical with those of the previous exemplary embodiments, their explanations are omitted.

FOURTH EXEMPLARY EMBODIMENT

Figure 14:
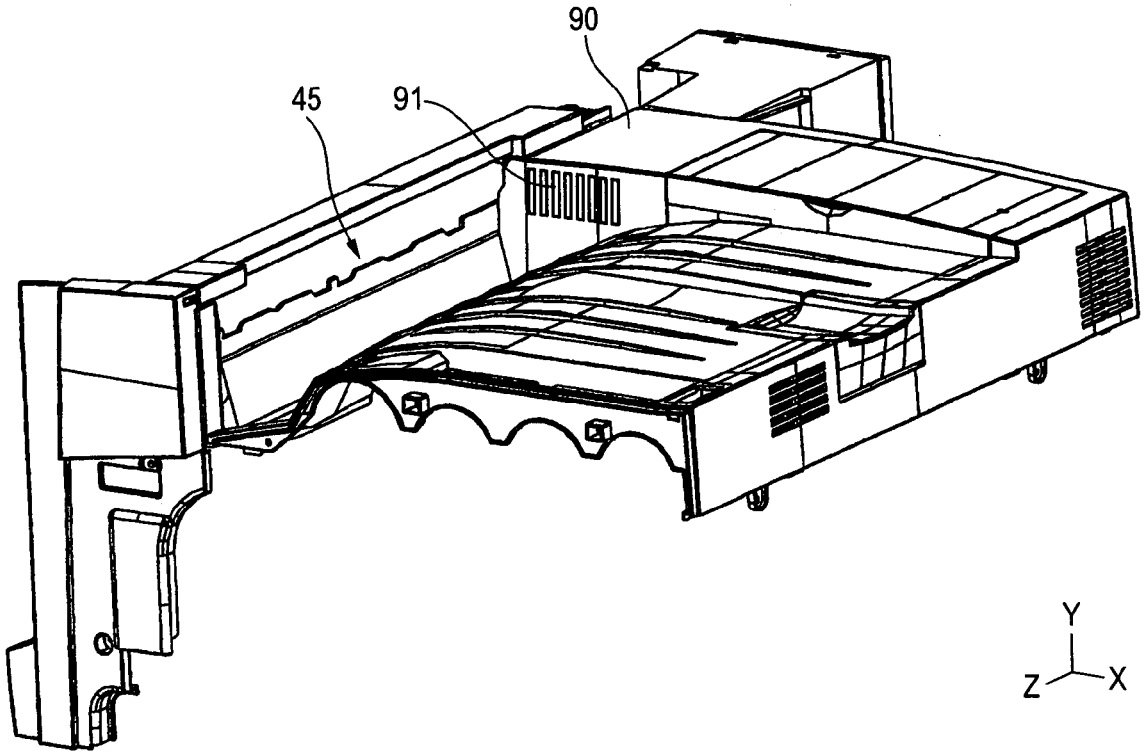
FIG. 14 is a perspective configuration diagram showing the main portion of a multifunctional color machine, which serves as an image forming apparatus according to a fourth exemplary embodiment of the invention.

FIG. 14 shows a fourth exemplary embodiment of the invention. Those elements, which are the same as those of the first exemplary embodiment, are assigned the same reference numerals. In the fourth exemplary embodiment, suction openings are formed in a cover of the main body of the image forming apparatus in the vicinity of the recording-medium ejecting portion. A part of an exhaust path inside the main body of the image forming apparatus doubles as the suction duct. The air, which is suctioned from the vicinity of the recording-medium ejecting portion through the suction openings, is introduced into the exhaust path inside the main body of the image forming apparatus.

As shown in FIG. 14, in the multifunctional color machine of the fourth exemplary embodiment, the suction duct 61 is not provided outside the main body 1 of the multifunctional color machine, but the suction duct 61 is formed of an exterior cover 90 of the main body 1 of the multifunctional color machine.

Figure 15:
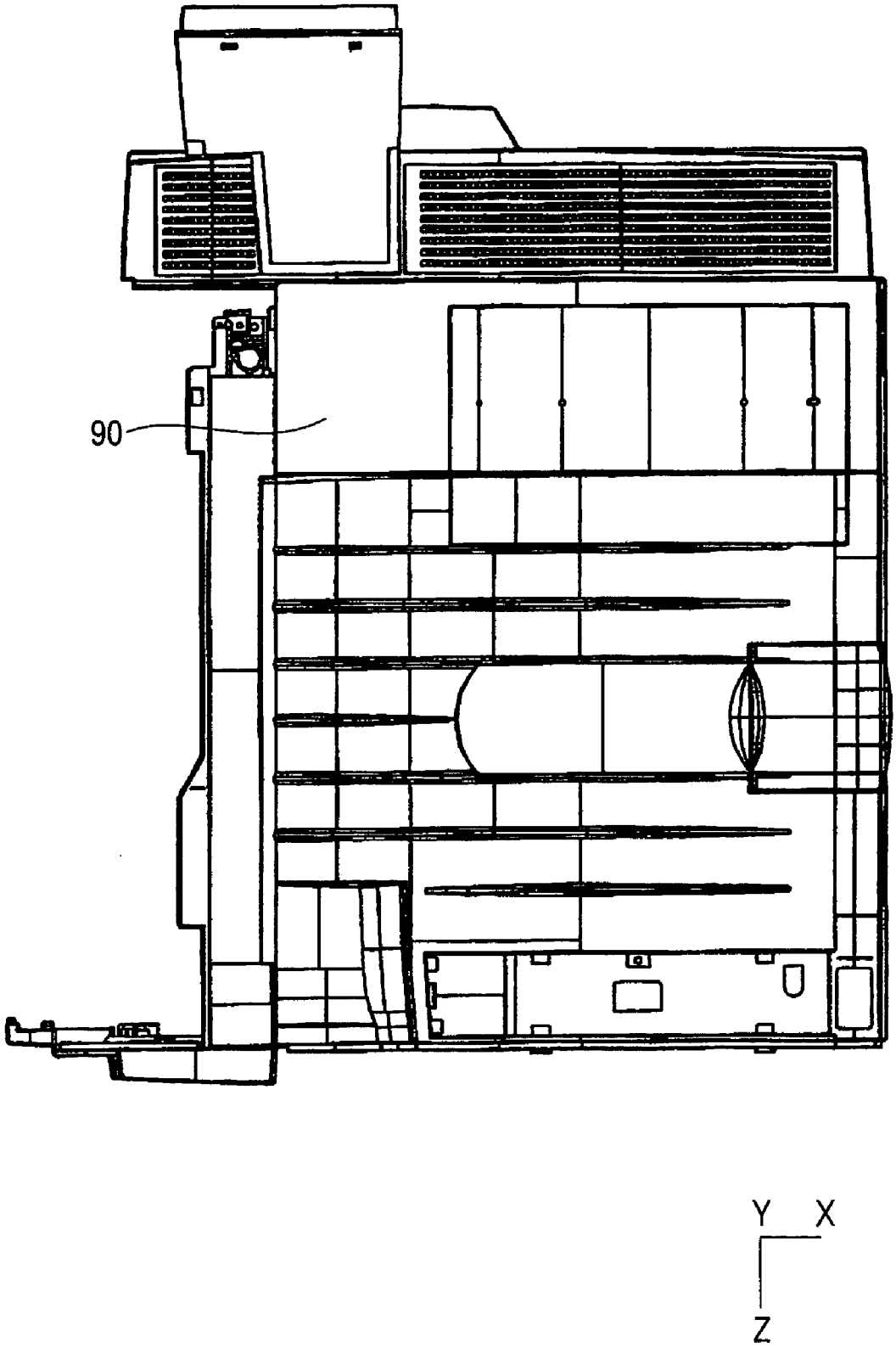
FIG. 15 is a plane configuration diagram showing the main portion of the multifunctional color machine, which serves as the image forming apparatus according to the fourth exemplary embodiment of the invention.
Figure 16:
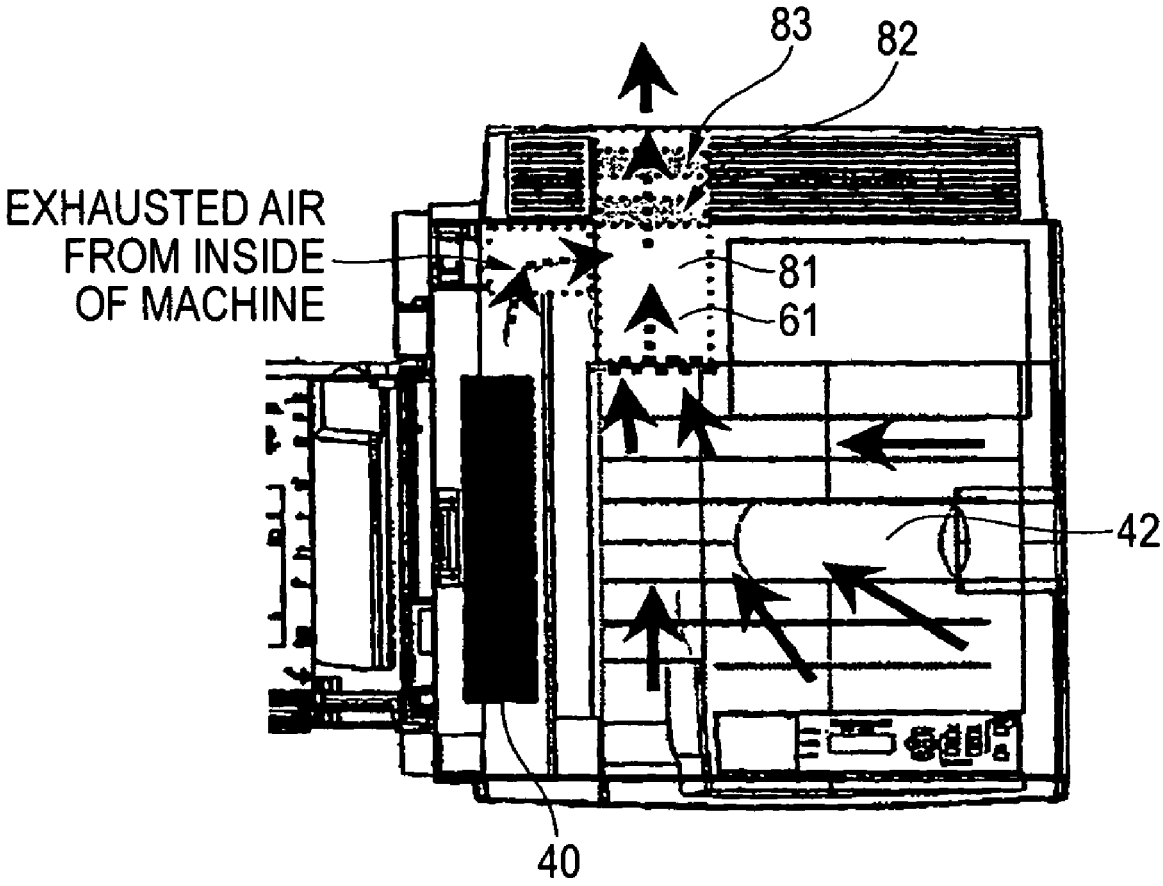
FIG. 16 is a plane configuration diagram showing the main portion of the multifunctional color machine, which serves as the image forming apparatus according to the fourth exemplary embodiment of the invention.

In more detail, as shown in FIGS. 14 and 15, in the multifunctional color machine of the fourth exemplary embodiment, a suction opening portion 91 is formed in the exterior cover 90 of the main body 1 in the vicinity of the sheet ejecting portion 45 and at a position corresponding to the rear side surface of the sheet ejecting portion 45. As shown in FIG. 16, the suction opening portion 91 is coupled to a part of the exhaust path 81 used for discharging heat originating from the fixing unit 40 in the main body 1 of the multifunctional color machine. According to this configuration, the part of the exhaust path 81 doubles as the suction duct 61. The air, which is suctioned from the vicinity of the sheet ejecting portion 45 through the suction opening portion 91, is introduced into the exhaust path 81 inside the main body 1 of the multifunctional color machine.

Even if the part of the exhaust path 81 is sued as the suction duct 61, the suction duct 61 is coupled to (merged with) an exit portion of the exhaust path 81 for exhausting air from the inside of the main body 1 of the multifunctional color machine to the outside, that is, coupled to a position, which is in the vicinity of the exhaust fan 82 and on the upstream side of the exhaust fan 82 as shown in FIG. 16. Therefore, the air suctioned through the suction duct 61 does not flow into the inside of the main body 1 of the multifunctional color machine. That is, the suction duct 61 is provided in a position other than the main body 1 of the multifunctional color machine 1.

As shown in FIG. 14, in the fourth exemplary embodiment, the suction opening portion 91 is formed in the exterior cover 90 of the multifunctional color machine 1. Hence, air, which is discharged along from the sheet ejecting portion 45 along with the sheet 30, may not be suctioned effectively.

Figure 17A:
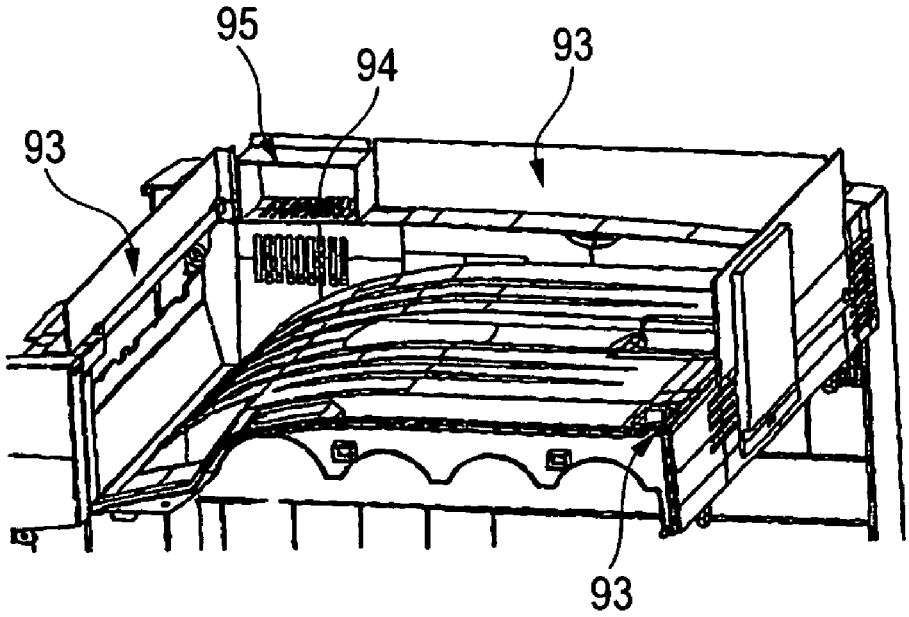
FIGS. 17A and 17B are a perspective configuration diagram and a front configuration diagram, showing the main portion of a modification of the multifunctional color machine, which serves as the image forming apparatus according to the fourth exemplary embodiment of the invention.
Figure 17B:
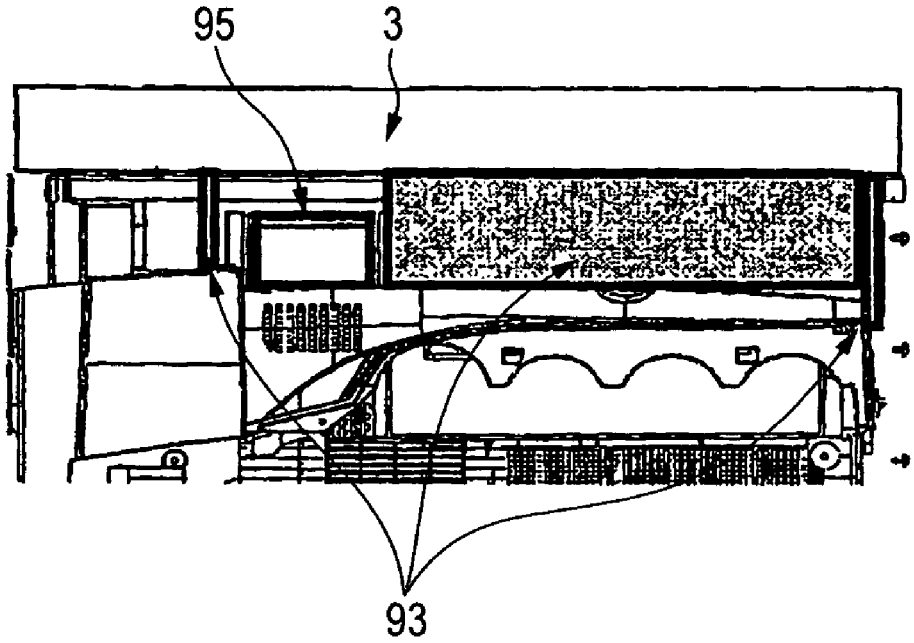

As shown in FIG. 17, in this case, the space between the main body 1 of the multifunctional color machine and the scanner unit 3 is covered with the shielding plate 93. Also, a suction opening portion 94 is provided in the upper end face of the exterior cover 90 of the main body 1 of the multifunctional color machine. A short suction duct 95 directed toward the sheet ejecting portion 45 is provided in the suction opening portion 94. According to this configuration, the air discharged from the sheet ejecting portion 45 along with the sheet 30 can be effectively suctioned.

Since the other configurations and operations of the fourth exemplary embodiment are identical with those of the previous exemplary embodiments in terms, their explanations are omitted.

FIFTH EXEMPLARY EMBODIMENT

Figure 18:
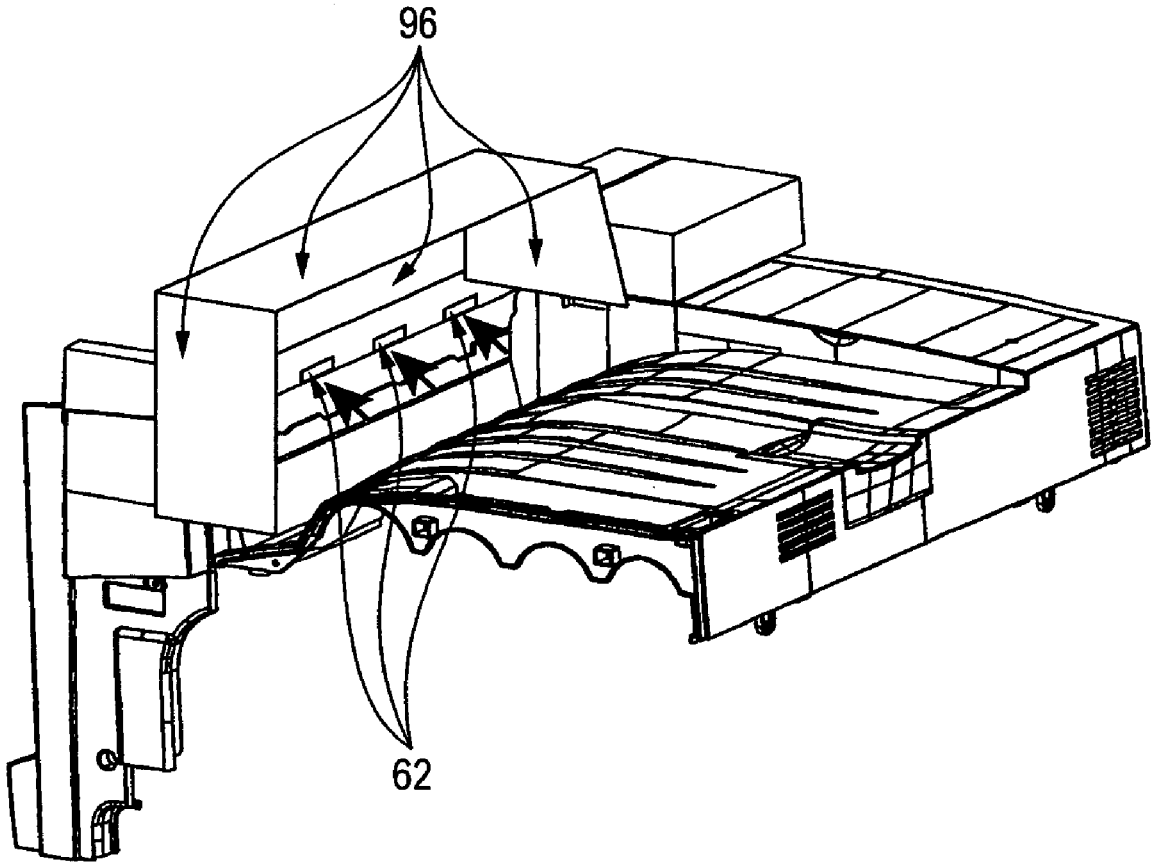
FIG. 18 is a perspective configuration diagram showing the main portion of a multifunctional color machine, which serves as an image forming apparatus according to a fifth exemplary embodiment of the invention.

FIG. 18 shows a fifth exemplary embodiment of the invention. Those elements, which are the same as those of the first exemplary embodiment, are assigned the same reference numerals. The fifth exemplary embodiment further includes a cover that covers an outer periphery of the recording-medium ejecting portion.

As shown in FIG. 18, in the multifunctional color machine of the fifth exemplary embodiment, the suction ports 62 are opened not in the lower surface of the suction duct 61 but in a side surface of the suction duct on the sheet ejection side. Further, a cover 96 for covering the outer periphery of the sheet ejection side of the sheet ejecting portion 45 is provided.

As shown in FIG. 18, the cover 96 is provided to have a predetermined length on the sheet ejection side of the sheet ejecting portion 45 so as to cover a rear space, an upper space, and a proximal space of the sheet ejecting portion 45 and a space above the sheet ejecting portion 45. Only the space close to the area on the ejection side to which the sheet 30 is ejected is opened.

As shown in FIG. 18, the multifunctional color machine of the fifth exemplary embodiment is provided with the cover 96 for covering the outer periphery of the sheet ejecting portion 45. After the sheet 30 has been ejected to the face-down tray 42, the cover 96 can suction the odor or VOC emitted from the sheet 30 in a concentrated manner.

Since the other configurations and operation of the fifth exemplary embodiment are identical with those of the previous embodiments, their explanations are omitted.

SIXTH EXEMPLARY EMBODIMENT

Figure 19:
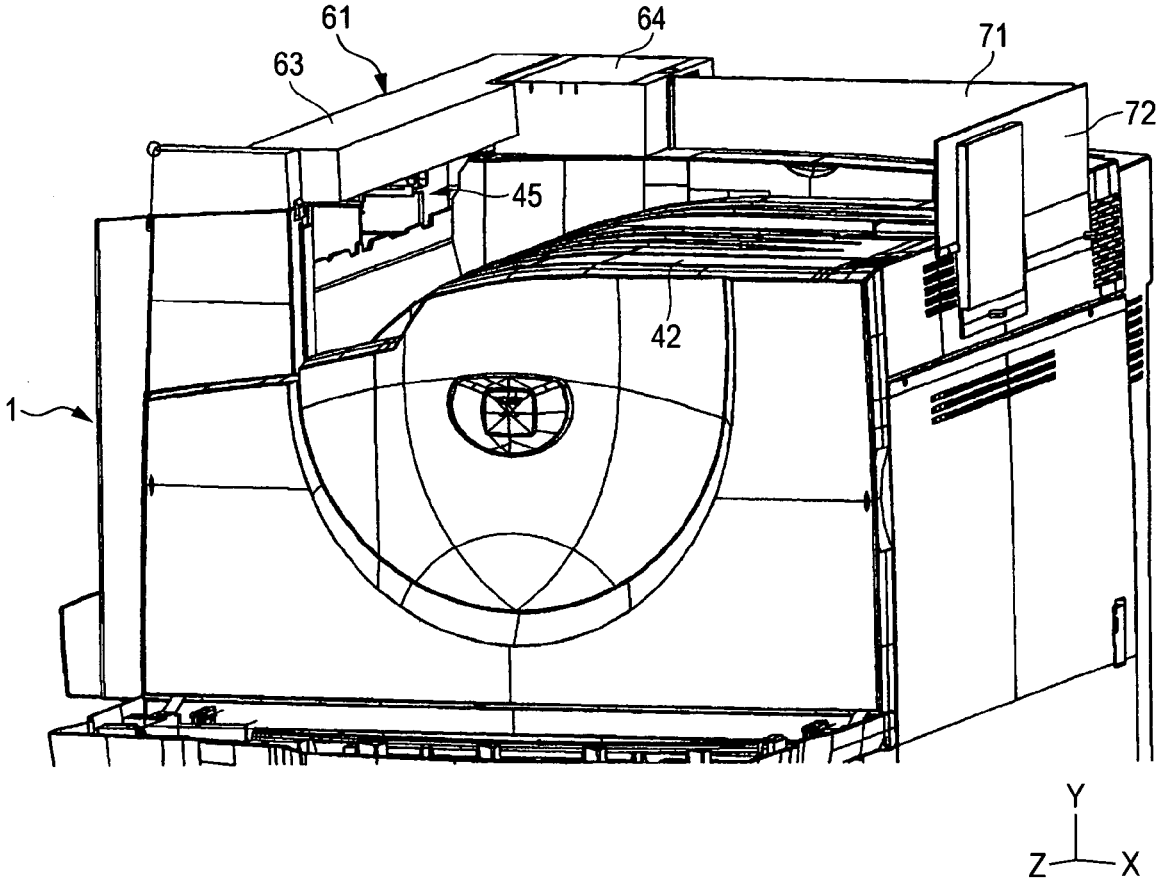
FIG. 19 is a perspective configuration diagram showing the main portion of a multifunctional color machine, which serves as an image forming apparatus according to a sixth exemplary embodiment of the invention.

FIG. 19 shows a sixth exemplary embodiment of the invention. Those elements, which are the same as those of the first exemplary embodiment, are assigned the same reference numerals. In the sixth exemplary embodiment, the suctioning/exhausting unit is detachable from the main body of the image forming apparatus.

Figure 20:
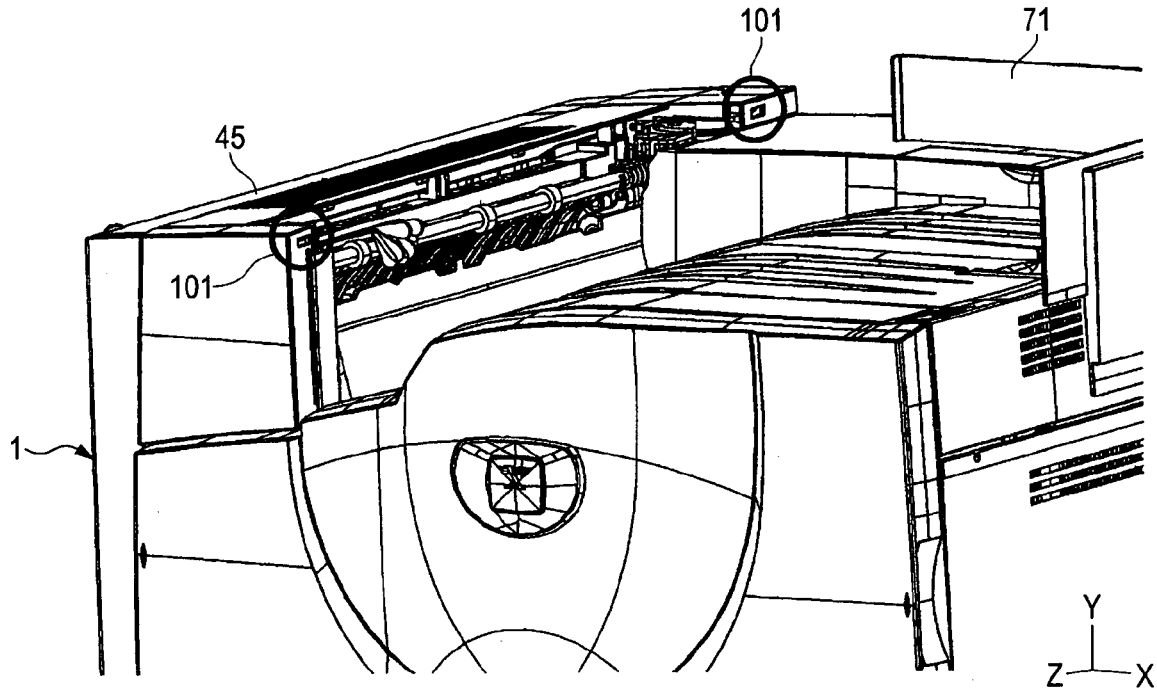
FIG. 20 is a perspective configuration diagram showing the main portion of the multifunctional color machine, which serves as the image forming apparatus according to a sixth exemplary embodiment of the invention.

As shown in FIG. 19, the multifunctional color machine according to the sixth exemplary embodiment includes the suction duct 61, which serves as a suctioning/exhausting unit, as in the first exemplary embodiment. The suction duct 61 includes a linear portion 63 disposed above the sheet ejecting portion 45; and an exhaust portion 64 configured to cross the linear portion 63 at right angles As shown in FIG. 20, the suction duct 61 is attached to the main body 1 of the multifunctional machine freely detachably. The suction duct 61 is configured so that before a user begins to use the multifunctional color machine or after the user has begun to use the multifunctional color machine, the suction duct 61 can be attached to and detached from the main body 1 according to need.

Figure 21:
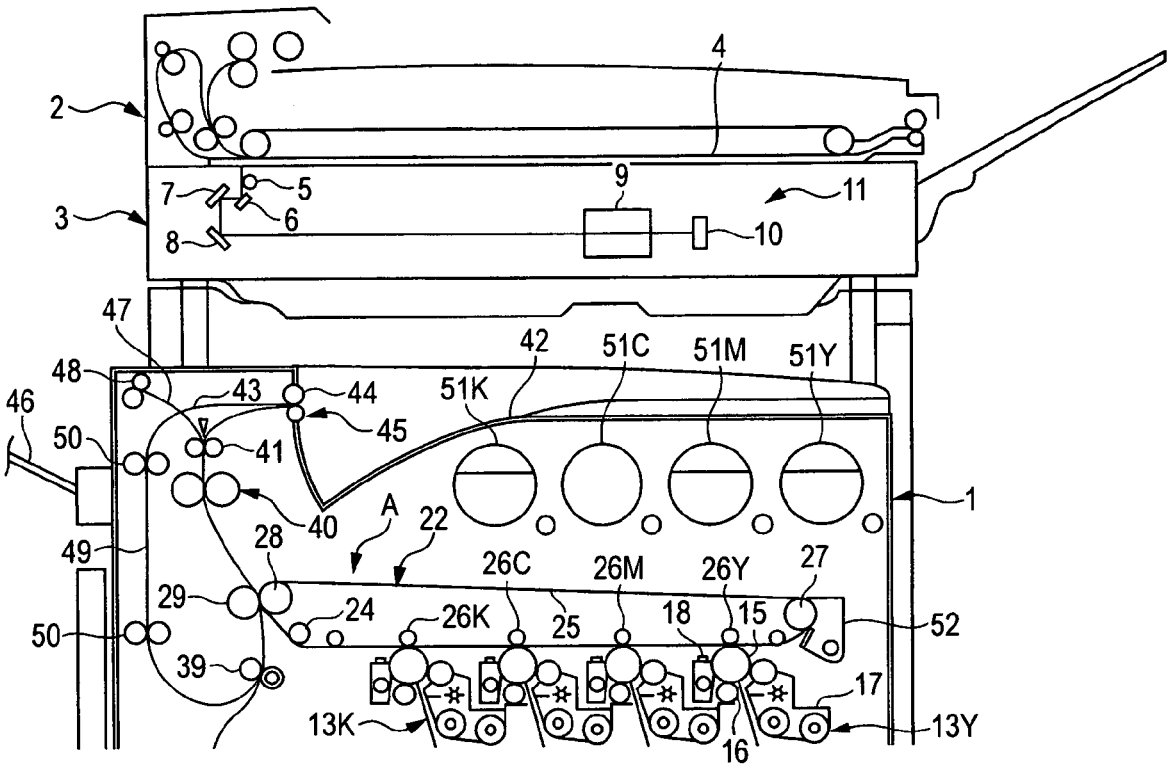
FIG. 21 is a configuration diagram showing the multifunctional color machine, which serves as the image forming apparatus according to a sixth exemplary embodiment of the invention, before a duct is mounted.

As shown in FIG. 21, before the suction duct 61 is attached to the multifunctional color machine, no member is disposed above the paper ejecting portion 45. That is, the scanner unit 3 is disposed above the paper ejecting portion 45 via a space.

If at the time when the multifunctional color machine is installed or after the multifunctional color machine is installed, number of prints increases significantly or the installation position of the multifunctional color machine gives rise to need for preventing odor or volatile organic compositions from being exhausted from the main body 1 to the outside, the suction duct can be attached to the main body 1 of the multifunctional color machine easily.

Figure 22:
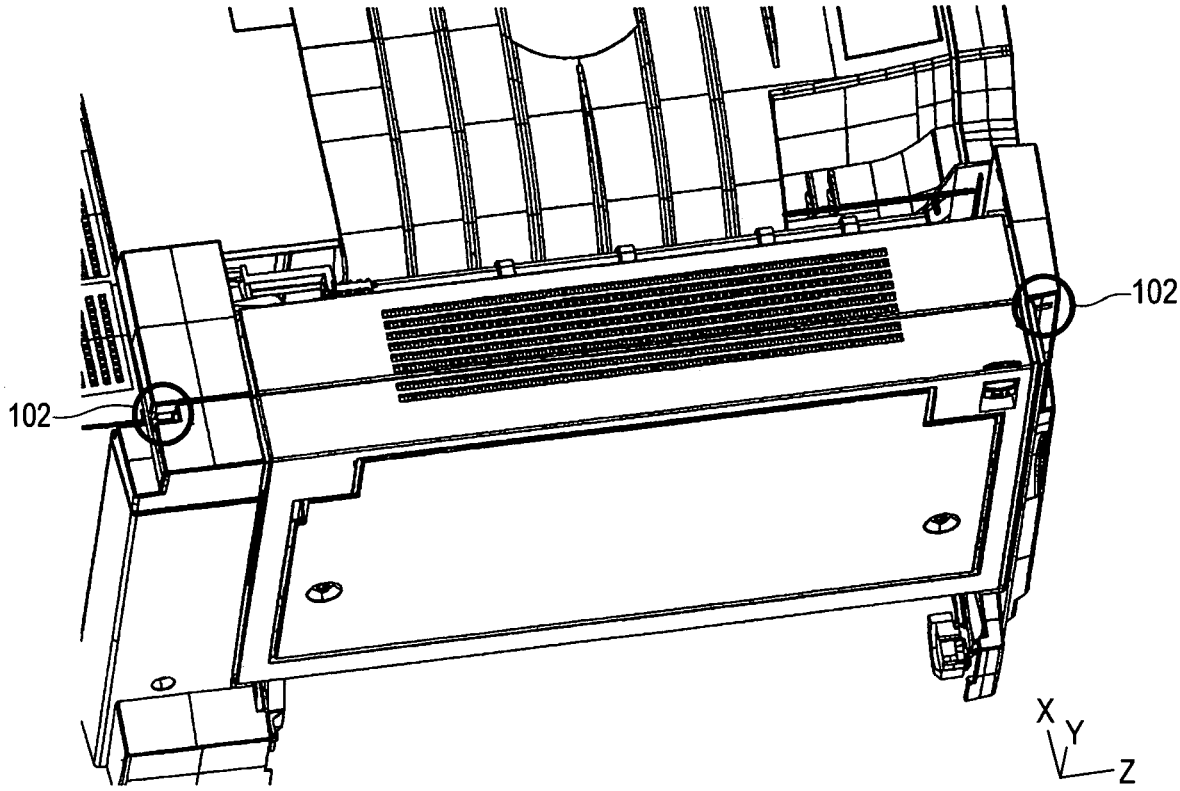
FIG. 22 is a perspective configuration diagram showing the main portion of the multifunctional color machine, which serves as the image forming apparatus according to a sixth exemplary embodiment of the invention.

As shown in FIG. 20, in the main body 1 of the multifunctional color machine, plural attachment holes 101 are formed in side surfaces of the sheet ejecting portion 45. The side surfaces of the sheet ejecting portion 45 protrude upwardly along one side surface of the main body 1 of the multifunctional color machine (in FIG. 20, the left side surface) so as to have a parallelepiped shape. The attachment holes 101 are used to attach the suction duct 61 to the main body 1 of the multifunctional color machine. As shown in FIG. 20, the attachment holes 101, which are used to attach the linear portion 63 of the suction duct 61, are respectively formed in a front end and a rear end of the side surface of the sheet ejecting portion 45 on the face-down tray 42. Also, as shown in FIG. 22, attachment holes 102 are formed on an opposite side of the sheet ejecting portion 45 to the face-down tray 42. Specifically, the attachment holes 102 are formed in positions, which are opposite to the attachment hole 101 at the front end and the attachment hole 101 at the rear end, respectively. The attachment holes 102 are used to attach the linear portion 63 of the suction duct 61.

Figure 23:
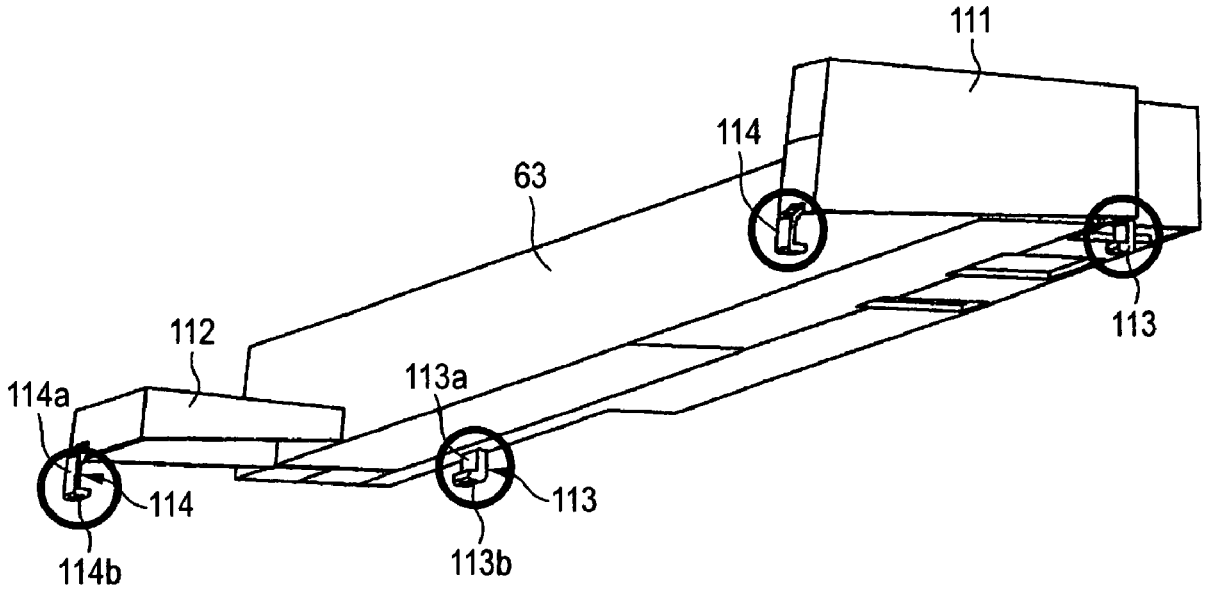
FIG. 23 is a perspective configuration diagram showing a duct member.
Figure 24:
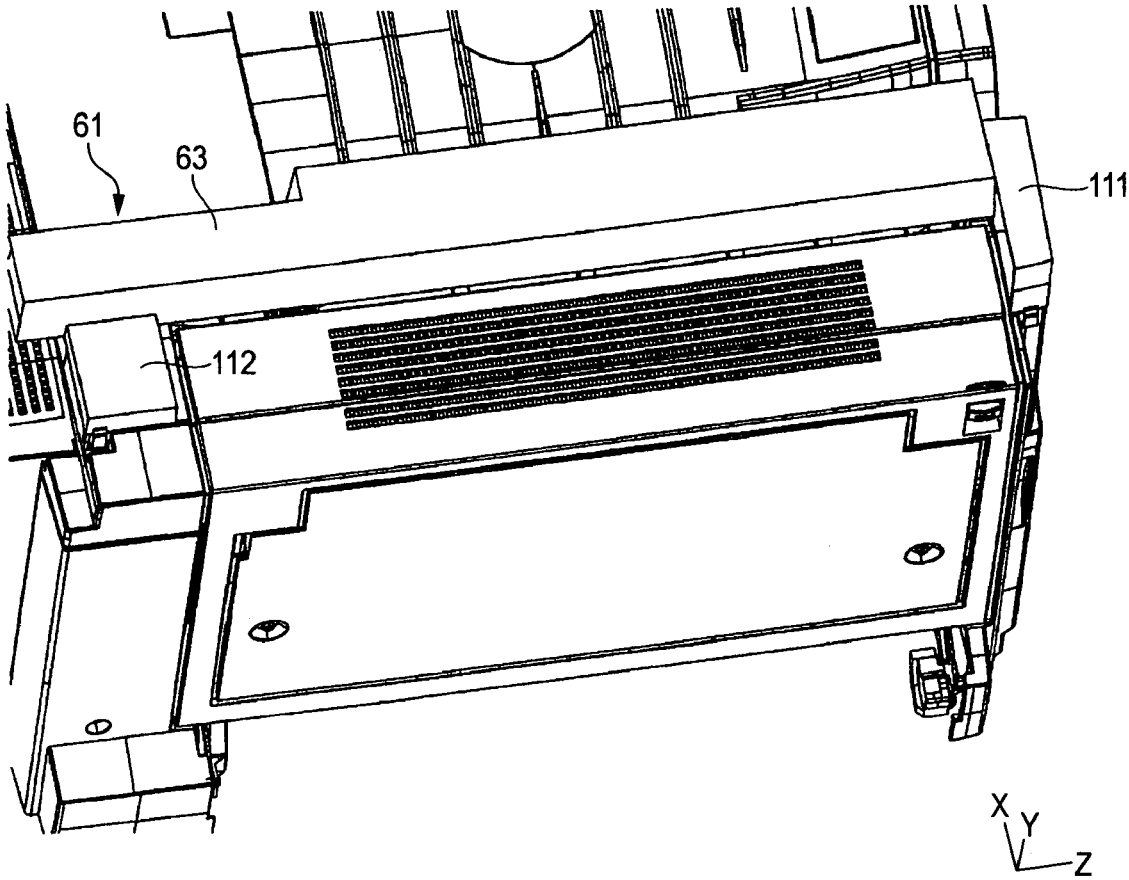
FIG. 24 is a perspective configuration diagram showing the multifunctional color machine, which serves as the image forming apparatus according to a sixth exemplary embodiment of the invention with the duct mounted on the multifunctional color machine.

On the other hand, as shown in FIGS. 23 and 24, for the purpose of attaching the suction duct 61 onto the sheet ejecting portion 45 of the main body 1 of the multifunctional color machine, the suction duct 61, the suction duct 61 includes a first attachment portion 111 on the front side (+Z direction) of an outer side surface thereof. The first attachment portion 111 has a shape in conformity with the shape of the sheet ejecting portion 45. The suction duct 61 also includes a second attachment portion 112 having a parallelepiped shape on the rear side (−Z direction) of the outer side surface thereof. The second attachment portion 112 is sued to attach the suction duct 61 to the sheet ejecting portion 45.

Figure 25:
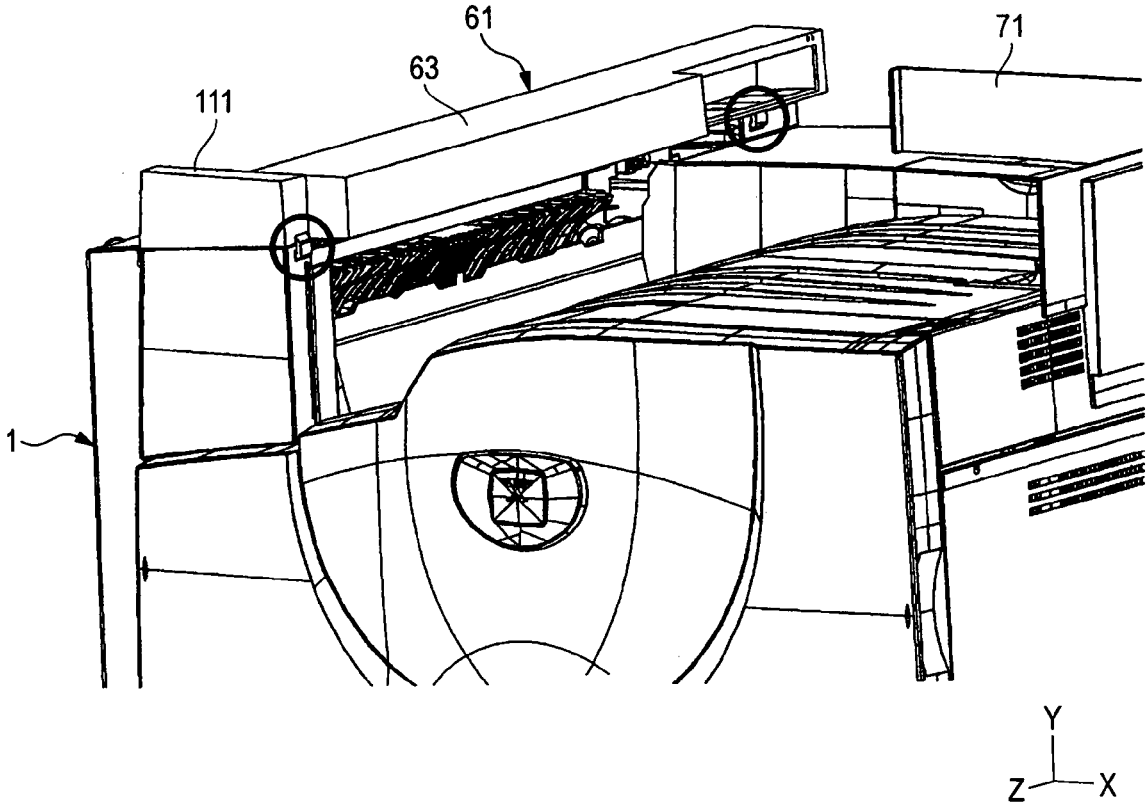
FIG. 25 is a perspective configuration diagram showing the multifunctional color machine, which serves as the image forming apparatus according to a sixth exemplary embodiment of the invention with the duct mounted on the multifunctional color machine.

As shown in FIG. 23, attachment claws 113, 114 are provided on the bottom surface of the suction duct 61 at positions corresponding to the attachment holes 101, 102. The attachment claws 113, 114 protrude downward from the bottom surface of the suction duct 61 so as to have a substantial L shape. Flat plate portions 113*a*, 114*a* of the attachment claws 113, 114, which extend downward, elastically deforms, and then end portions 113*b*, 114*b*, which are bent inward, are inserted into the attachment holes 101, 102 of the sheet ejecting portion 45 as shown in FIGS. 24 and 25. As a result, the suction duct 61 is attached to a predetermined position on the sheet ejecting portion 45 of the main body 1 of the multifunctional color machine.

It should be noted that number of the attachment holes 101, 102 and number of the attachment claws 113, 114 are not limited to four (shown in this exemplary embodiment) and that positions of those components are not limited to this exemplary embodiment.

Figure 26:
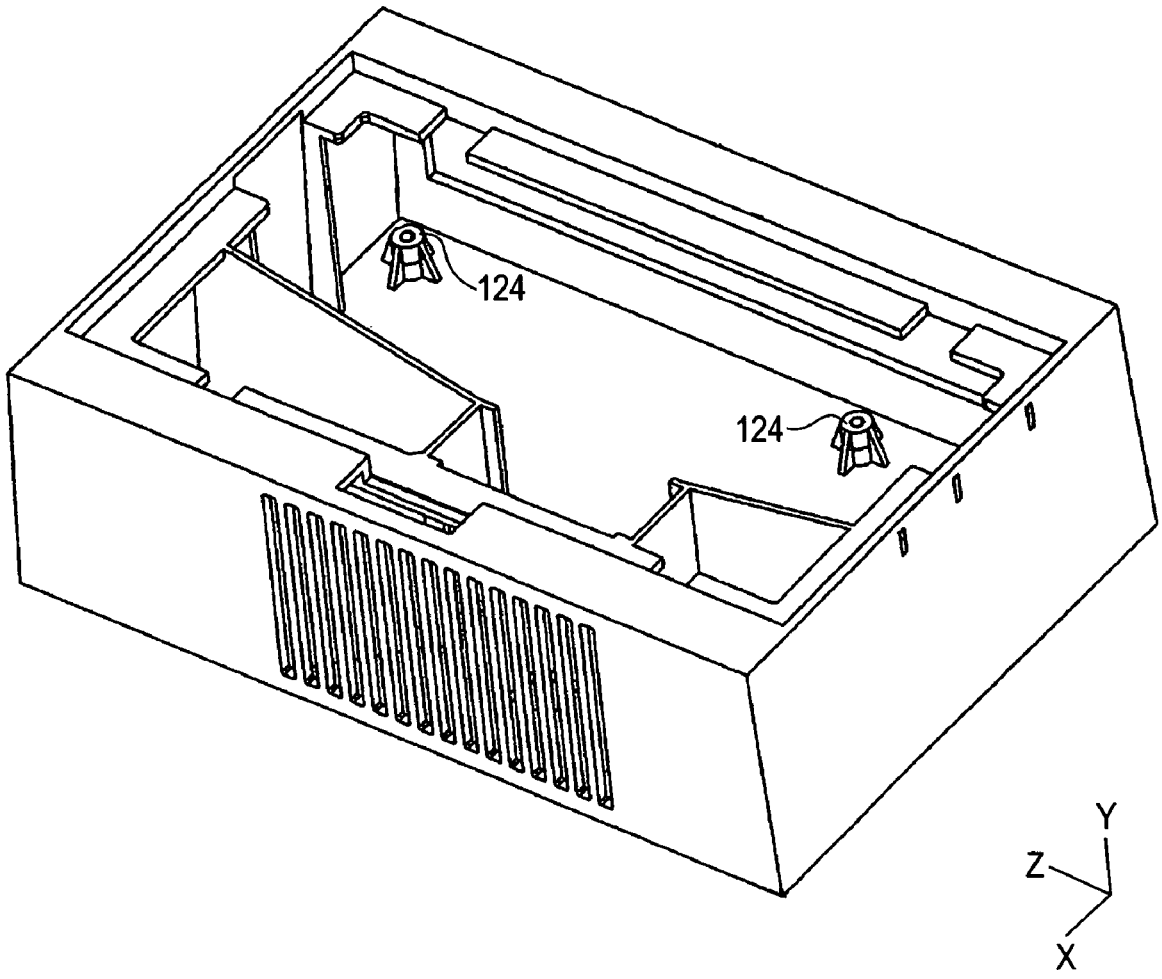
FIG. 26 a perspective configuration diagram showing the duct member.
Figure 27:
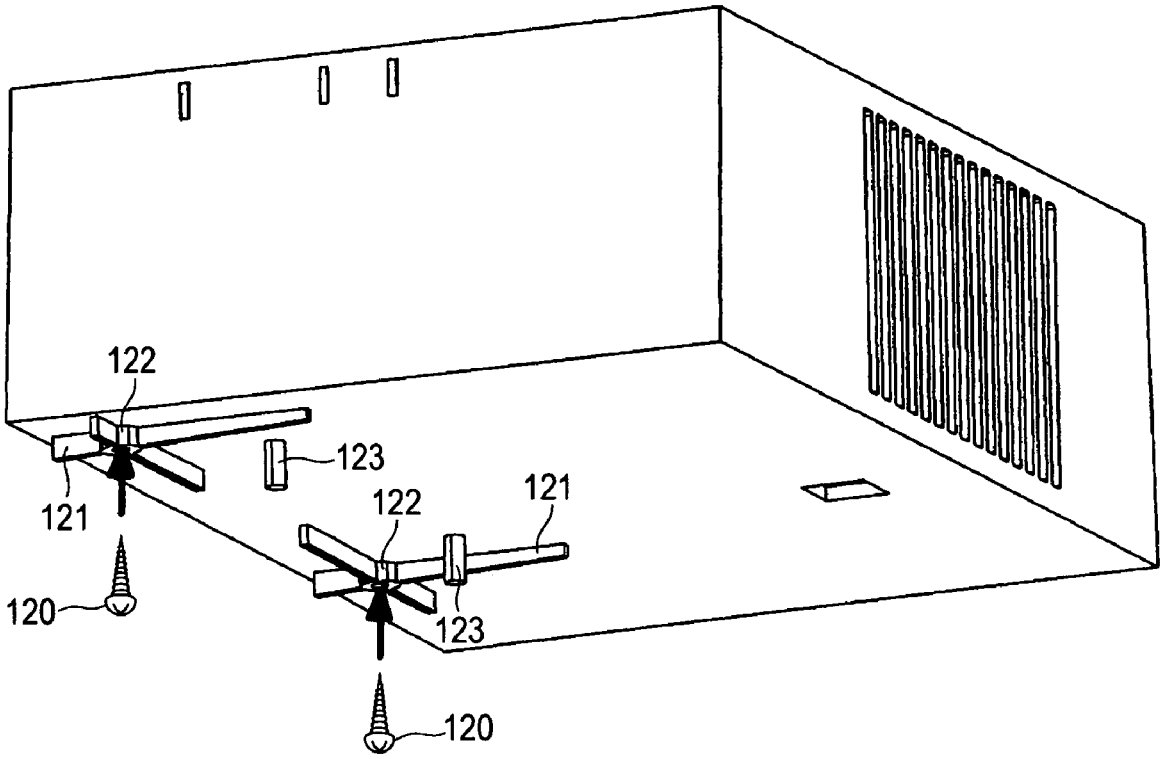
FIG. 27 is a perspective configuration diagram showing a state where the duct member is mounted.

Also, as shown in FIGS. 26 and 27, the exhaust portion 64 of the suction duct 61 is formed into a box shape. The exhaust portion 64 is attached to the rear side of the main body 1 of the multifunctional color machine with fixing member 120 such as a tapping screw. As shown in FIG. 27, screw holes 122 of a cylinder shape are opened in the bottom surface of the exhaust portion 63. Reinforcement ribs 121 of a cross shape reinforce the screw holes 122. Also, positioning projections 123 protrude downward from the bottom surface of the exhaust portion 64. Also, as shown in FIG. 26, screw holes 124 of a cylinder shape protrude from the inner bottom surface of the exhaust portion 64.

As shown in FIG. 27, the exhaust portion 64 of the suction duct 61 is attached by screwing the tapping screws 120 from the back surface of the cover of the main body 1 so that tip ends of the tapping screws 120 are inserted up to predetermined positions of the screw holes 122, 124, which are formed on the bottom surface of the exhaust portion 64, while threading the screw holes 122, 124. As a result, the exhaust portion 64 is fixed to the main body 1 by the tapping screws 120.

As shown in FIG. 25, the linear portion 63 and the exhaust portion 64 of the suction duct 61, which are attached as described above, are joined so that air is not leaked through a gap between the linear portion 63 attached earlier and the exhaust portion 64 attached later.

Also, when the suction duct 61 is to be detached, the linear portion 63 and the exhaust portion 64 of the suction duct are detached from the main body 1 of the multifunctional color machine in a reverse manner to the attachment work.

Since the other configurations and operation of the sixth exemplary embodiment are identical with those of the previous embodiments, their explanations are omitted.

What is claimed is:

1. An image forming apparatus comprising:

a recording-medium stacking portion;

a recording-medium ejecting portion that ejects a recording medium on which an image is formed, to the recording-medium stacking portion;

a suctioning/exhausting unit that suctions air in a vicinity of the recording-medium ejecting portion, the suctioning/exhausting unit includes a suction duct that exhausts the suctioned air through a filter to an outside of a main body of the image forming apparatus;

an image reading device that reads an original document, the image reading device mounted over the main body of the image forming apparatus, wherein:

the recording-medium stacking portion is disposed inside a body formed of the main body of the image forming apparatus and the image reading device, the suction duct includes a suction which lies in a plane formed by a suction-port-side end portion of the suction duct, and the plane is substantially parallel to an upper surface of the recording medium being ejected.

2. The apparatus according to claim 1, wherein:

the suctioning/exhausting unit comprises the suction duct disposed above the recording-medium ejecting portion.

3. The apparatus according to claim 2, further comprising:

an exhaust fan disposed inside of the main body of the image forming apparatus, wherein:

the suction duct is merged with an exhaust path disposed inside the main body of the image forming apparatus, the exhaust fan exhausts the air in the vicinity of the recording-medium ejecting portion through the suction duct and air in the main body of the image forming apparatus through the exhaust duct, and the filter is disposed on an upstream side of a merging position where the suction duct and the exhaust path are merged with each other, in an air exhaust direction.

4. The apparatus according to claim 2, further comprising:

an exhaust fan disposed inside of the main body of the image forming apparatus, wherein:

the suction duct is merged with an exhaust path disposed inside the main body of the image forming apparatus, the exhaust fan exhausts the air in the vicinity of the recording-medium ejecting portion through the suction duct and air in the main body of the image forming apparatus through the exhaust duct, the air suctioned through the suction dust duct is exhausted through the filter to the outside of the image forming apparatus, and the air suctioned through the exhaust path is exhausted through the filter to the outside of the image forming apparatus.

5. The apparatus according to claim 4, wherein the filter has at least two selected from the group consisting of (i) a deodorization capability, (ii) a capability of absorbing or decomposing a volatile organic compound and (iii) a capability of absorbing or decomposing ozone.

6. The apparatus according to claim 4, wherein the filter comprises at least two selected from the group consisting of (i) a deodorization filter, (ii) a filter for absorbing or decomposing a volatile organic compound and (iii) a filter for absorbing or decomposing ozone.

7. The apparatus according to claim 2, wherein:

suction openings are formed in a cover of the main body of the image forming apparatus in the vicinity of the recording-medium ejecting portion, a part of an exhaust path inside the main body of the image forming apparatus doubles as the suction duct, and the air, which is suctioned from the vicinity of the recording-medium ejecting portion through the suction openings, is introduced into the exhaust path inside the main body of the image forming apparatus.

8. The apparatus according to claim 2, further comprising:

a cover that covers an outer periphery of the recording-medium ejecting portion.

9. the apparatus according to claim 1, wherein:

the suctioning/exhausting unit comprises the suction duct, a exhausting fan and the filter, and the suction duct, the exhausting fan and the filter are independent from the main body of the image forming apparatus.

10. The apparatus according to claim 1, wherein the suctioning/exhausting unit operates for a predetermined period after an image forming operation is completed.

11. The apparatus according to claim 1, wherein the suctioning/exhausting unit is detachable from the main body of the image forming apparatus.

12. An image forming apparatus comprising:

a recording-medium stacking portion;

a recording-medium ejecting portion that ejects a recording medium on which an image is formed, to the recording-medium stacking portion; and a suctioning/exhausting unit that suctions air in a vicinity of the recording-medium ejecting portion, the suctioning/exhausting unit includes a suction duct disposed above the recording-medium ejection portion and exhausts the suctioned air through a filter to an outside of a main body of the image forming apparatus, wherein a suction port is provided on one side of the suction duct, the suction duct includes a suction port which lies in a plane formed by a suction-port-side end portion of the suction duct, and the plane is substantially parallel to an upper surface of the recording medium being ejected.

* * * * *